US005564859A

United States Patent [19]

Lochtefeld

[11] Patent Number: 5,564,859

[45] Date of Patent: Oct. 15, 1996

[54] METHOD AND APPARATUS FOR IMPROVING SHEET FLOW WATER RIDES

[76] Inventor: Thomas J. Lochtefeld, 5508 Pacifica Dr., La Jolla, Calif. 92037

[21] Appl. No.: 393,071

[22] Filed: Feb. 23, 1995

Related U.S. Application Data

[63] Continuation of Ser. No. 74,300, Jun. 9, 1993, Pat. No. 5,393,170, which is a continuation of Ser. No. 577,741, Sep. 4, 1990, Pat. No. 5,236,280, which is a continuation-in-part of Ser. No. 286,964, Dec. 19, 1988, Pat. No. 4,954,014, which is a continuation-in-part of Ser. No. 54,521, May 27, 1987, Pat. No. 4,792,260.

[51] Int. Cl.[6] ..... A63B 69/00; A63G 31/16; E02B 3/00

[52] U.S. Cl. ..... 405/79; 405/52

[58] Field of Search ..... 405/79, 52, 21; 4/491; 472/13, 128, 129

[56] References Cited

U.S. PATENT DOCUMENTS

| | | | |
|---|---|---|---|
| 3,557,559 | 1/1971 | Barr | 405/79 |
| 3,802,697 | 4/1974 | Le Mehaute | 405/79 X |
| 3,913,332 | 10/1975 | Forsman | 405/79 |
| 4,954,014 | 9/1990 | Sauerbier et al. | 405/79 |

*Primary Examiner*—Dennis L. Taylor
*Attorney, Agent, or Firm*—Knobbe, Martens, Olson & Bear

[57] ABSTRACT

An amusement apparatus for water sports activities wherein a flowing body of water is provided. The water moves across an inclined, declined or horizontal riding surface upon which the velocity, volume and gravitational dynamics of the flowing body of water is such that a rider may perform water skimming/simulated surfing maneuvers thereon. Composite structures with horizontal and inclined surfaces and varying flow velocity over time across specifically shaped structures permit water skimming/simulated surfing maneuvers on unbroken, spilling or tunnel type wave forms. Asymmetry in the downstream ridge line of an inclined surface allows spilling type wave formations as well as facilitating the removal of a transient surge. A novel fluid "half-pipe" waveform is also introduced.

44 Claims, 19 Drawing Sheets

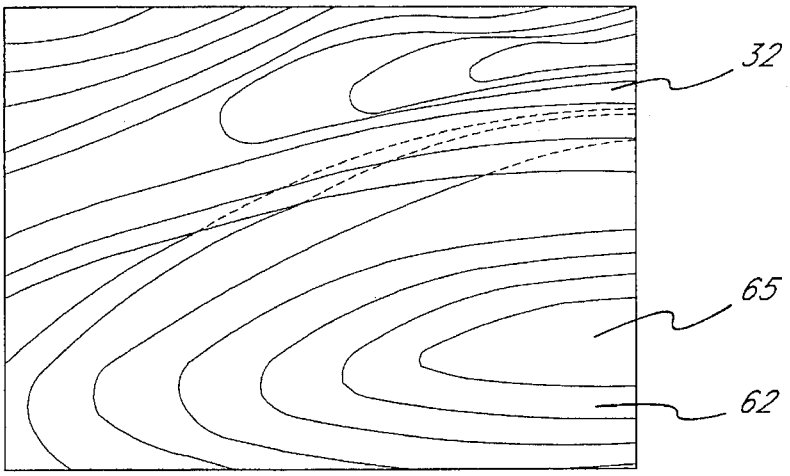
FIG. 12
FIG. 14a
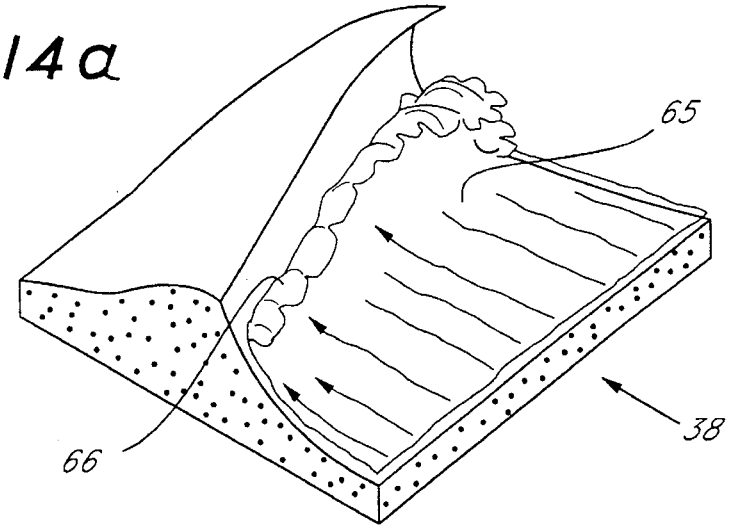
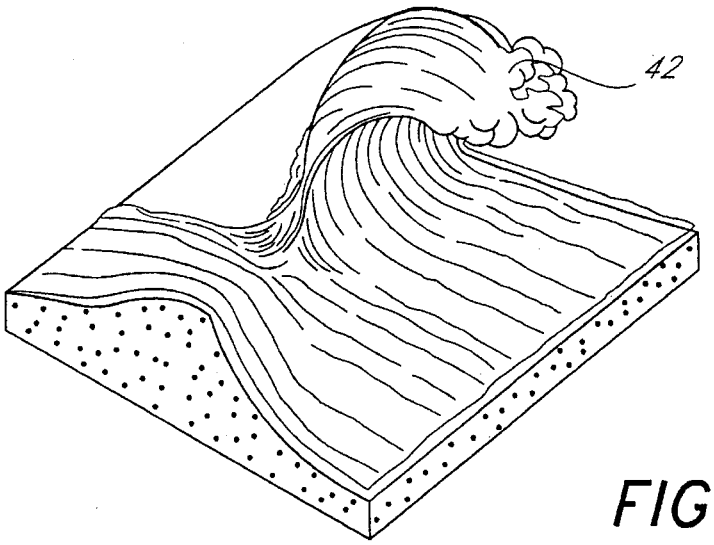
FIG. 14b

METHOD AND APPARATUS FOR IMPROVING SHEET FLOW WATER RIDES

RELATED APPLICATIONS

This application is a continuation of application Ser. No. 08/074,300, filed Jun. 9,1993 now as U.S. Pat. No. 5,393, 170, which is a continuation of application Ser. No. 577,741, filed Sep. 4, 1990, now U.S. Pat. No. 5,236,280 which is a Continuation-In-Part of U.S. application Ser. No. 07/286, 964, filed Dec. 19, 1988 for IMPROVEMENTS IN SURFING-WAVE GENERATORS, issued as U.S. Pat. No. 4,954, 014 on Sep. 4, 1990, which is a Continuation-In-Part of U.S. application Ser. No. 07/054/521, filed May 27, 1987 for TUNNEL WAVE GENERATOR, issued as U.S. Pat. No. 4,792,260 on Dec. 20, 1988.

FIELD OF THE INVENTION

The present invention relates in general to water rides, specifically a mechanism and process that provides a flowing body of water having flat, radial, and inclined surfaces thereon of sufficient area, depth and slope to permit surfboarding, skim-boarding, body-boarding, inner-tubing, and other water-skimming activity and, in particular, to several embodiments with means for generated, forming, maintaining, moving and riding said flow of water in a predominantly steady state condition.

BACKGROUND OF THE INVENTION

For the past 25 years, surfboard riding and associated wave riding activities, e.g., knee-boarding, body or "Boogie" boarding, skim-boarding, surf-kayaking, inflatable riding, and body surfing (all hereinafter collectively referred to as wave-riding) have continued to grow in popularity along the world's surf endowed coastal shorelines. In concurrence, the 80's decade has witnessed phenomenal growth in the participatory family water recreation facility, i.e., the waterpark. Large pools with manufactured waves have been an integral component in such waterparks. Several classes of wavepools have successfully evolved. The most popular class is that which enables swimmers or inner-tube/inflatable mat riders to bob and float on the undulating swells generated by the wave apparatus. A few pools exist that provide large turbulent white-water bores that surge from deep to shallow pool end. Such pools enable wave-riding. However, white-water bore riding is not preferred by the cognoscenti of the wave-riding world, rather the forward smooth water face of a curling or tubing wave that runs parallel to the shoreline holds the ultimate appeal. Although numerous attempts have been made to establish wave-riding on curling waves as a viable activity in the commercial waterpark wavepool setting, such attempts have met with limited success. The reasons which underlie wave-riding's limited waterpark success is four-fold, 1) small spilling or unbroken waves which are ideal for the mass of novice waterpark attendees are not ideal for intermediate or advanced wave-riders; 2) the larger waves ideal for wave riding have proven prohibitive in cost to duplicate and become inherently more dangerous as their size increases; 3) the curling and plunging waves sought by advanced wave riders require steep and irregular pool bottom configurations that are inherently dangerous and can cause strong deep water current; 4) assuming a compromised and safer wave shape is acceptable to wave-riding participants, wave-riding is ideally a one-man-to-one-wave event that monopolizes an extended surface area. As a consequence of limited wave quality, excessive cost, potential liability, and large surface area to low rider capacity ratios, wavepools specifically designed for waveriders have proven unjustifiable to water park operators.

All wavepools that currently exist in the waterpark industry and the majority of previously disclosed wave-making inventions attempt to duplicate those types of oscillatory waves found naturally occurring at a beach. For purposes of definition, such waves are hereinafter termed "natural waves". Natural waves also include those found occurring in rivers as caused by submerged obstacles e.g., boulders. As known to those skilled in the art, natural waves have specific characteristics capable of mathematical description as a function of wave length, wave height, period, wave angle, velocity, phase speed, break speed, gravity, free surface water elevation, water depth, etc. Additionally, mathematical descriptions can be provided for a wide range of wave shapes progressing from an unbroken-to-breaking-to broken. Breaking waves, those of most interest to wave-riders, are traditionally classified as either spilling, plunging or surging. Broken waves can either be stationary (e.g., a river impacting on an obstacle creating a stationary hydraulic jump), or moving (e.g., an ocean white water surge or bore characterized by rapidly varied unsteady flow). The shape of a breaking wave is primarily a function of a given set of the aforementioned wave characteristics and the contour of the bottom over which the wave is moving. Beginning wave-riders prefer the smaller gentle spilling wave produced by a gradually Sloped bottom surface. Advanced wave-riders prefer the larger plunging breakers that result from a steeply inclined beach. Since there are demographically a greater number of beginning wave-riders and since the wave favored by beginning riders is a product of an inherently safer gentle incline of beach, and since the energy and cost required to produce a small spilling wave is exponentially less that required to produce a large plunging wave, the current genre of wave pools have by necessity and practicality not been suitable for wave-riding by the more advanced wave rider.

The subject invention aims at creating a "wave shape" that can serve to provide those types of "wave shapes" desired by intermediate to advanced riders. Additionally, the subject invention seeks to accomplish such "wave shape" creation at a fraction of the cost and with an improved margin of safety as compared to that required to duplicate the aforementioned intermediate to advanced natural waves. The reason the subject invention can succeed at its goal is that it does not duplicate natural waves, rather, it creates "flow shapes" that are a result of high velocity sheet flow over a suitably shaped forming surface. This concept of sheet flow formation versus natural wave formation is one of two primary distinguishing factors between the subject invention and the prior art.

This second distinguishing factor focuses on the forces that "drive" a wave rider when he is riding a wave. To this end, the subject invention defines two distinct classes of flow shapes, i.e., deep water flow shapes and shallow water flow shapes. A deep water flow shape is where the water depth is sufficient such that boundary layer effects of the sheet flow over the forming surface does not influence the operation of rider or riding vehicle, e.g., surfboard. Deep water flow shapes can, assuming certain flow forming and flow characteristics (e.g., velocity) are met, duplicate naturally occurring waves. A shallow water flow shape is where the water is of such depth that the surface boundary layer effects of the sheet flow over the forming surface influences the operation of rider or riding vehicle, e.g., surfboard. As contemplated by the subject invention, shallow water flow shapes will never duplicate naturally occurring waves, because there are differing forces that come into play when a rider rides a shallow flow. As the result of those differing forces, the operational dynamics of the subject invention require that for shallow flows the average velocity of the water sheeting over the flow forming surface will always exceed the maximum velocity which would be found in a natural wave. To better explain why the shallow water flow velocity must always be greater than that of a deep water flow, and to further expand on the forces involved when a surfer rides an ocean wave or conversely when a "skimmer" rides a shallow water flow, the following examples are given: On a natural wave (a deep water flow environment) a surfer prior to starting a ride begins to move up the slope of the coming wave by primarily the forces of buoyancy. In order to overcome the forces of fluid drag, the surfer commences to paddle and take advantage of the interaction between the forces of buoyancy and gravity to provide a forward component to the surfboard and achieve riding speed. Thereafter, maintenance of a steady state position riding normal to the wave front is a balancing act between on the one hand, the hydrodynamic lift forces on the bottom of the surfboard coupled with buoyancy, and on the other hand, the forces of gravity and fluid drag. Cutting/trimming across the wave front (at an angle to the wave front) requires the same balancing act. If one attempts to reproduce the above described scenario in natural flow conditions, a large water depth is required. Likewise, in the laboratory setting this can be accomplished by deep water flows (reference the Killen papers, infra).

Conversely, in a shallow water flow environment, the forward force component of the "skimmer" and skimming device required to maintain a riding position and overcome fluid drag is due to the downslope component of the gravity force created by the constraint of the solid flow forming surface, balanced primarily by momentum transfer from the high velocity upward shooting flow. The "skimmer's" motion upslope (in excess of the kinetic energy of the "skimmer") consists of the force of the upward shooting flow exceeding the downslope component of gravity. In both deep water and shallow water flow environments, non-equilibrium riding maneuvers such as cross-slope motion and oscillating between different elevations are made possible by the interaction between the respective forces as described above and the use of the rider's kinetic energy.

The parent inventions to the subject applications have focused upon deepwater flow shapes specific to the performance of "surfing maneuvers". Surfing maneuvers, is defined by those skilled in the art, as those which occur under ocean like hydrodynamic conditions. Consequently, surfing maneuvers can be performed in an artificial environment, e.g., a wavepool, assuming that the wave which is produced duplicates the ocean wave riding experience (deep water flow) as described above. By corollary, true surfing maneuvers cannot be performed in shallow flow environments since the hydrodynamic conditions are distinct. However, full scale tests have demonstrated that the physical look and feel of "surfing like maneuvers" performed in a shallow flow are surprisingly similar to "real" surfing maneuvers performed in a deep flow. For purposes of technical clarity, shallow flow "surfing type maneuvers" shall be termed as a subset of what hereafter can be described as "water skimming maneuvers". Water skimming maneuvers are defined as those activities which can be performed on shallow water flows including "surfing like maneuvers" as well as other activities or other types of maneuvers with differing types of vehicles e.g. inner-tubes, bodyboards, etc.

The subject invention discloses improvements to the prior art of shallow water flows, as well as similar improvements to the deep water flow shapes of the parent invention. The parent invention generated two types of stationary flow shapes, i.e., a stationary peeling tunnel flow shape for advanced waveriders, and a stationary non-breaking upwardly inclined flow shape for beginners.

DISCUSSION OF PRIOR ART

The water recreation field is replete with inventions that generate waves yet lacking as to inventions that create flow formed wave-like shapes. In all cases, none to date describe the improvements contemplated by the subject invention, as an examination of some representative references will reveal.

To facilitate distinction, the prior art can be divided into seven broad wave or wave shape forming categories:

Category 1—an oscillating back-and-forth or periodic up-and-down movement by an object or pressure source that results in disturbance propagation from point to point over a free water surface. Representative prior art: Fisch U.S. Pat. No. 1,655,498; Fisch U.S. Pat. No. 1,701,842; Keller U.S. Pat. No. 1,871,215; Matrai U.S. Pat. No. 3,005,207; Anderson U.S. Pat. No. 3,477,233; Presnell et al U.S. Pat No. 3,478,444; Koster U.S. Pat. No. 3,562,823; Anderson U.S. Pat. No. 4,201,496; and Baker U.S. Pat. No. 4,276,664. The structure and operation of Category 1 prior art illustrate those types of devices which generate waves in an unsteady flow, i.e., a wave profile which will vary over distance and time.

Category 2—a moving hydraulic jump caused by the release of a quantity of water. Representative prior art: Dexter U.S. Pat. No. 3,473,334; Bastenhof U.S. Pat. No. 4,522,535; and Schuster, et al U.S. Pat. No. 4,538,719. Although differing in method, the structure and operation of Category 2 prior art is similar to Category 1 in that they generate waves in an unsteady flow, i.e., a wave profile which will vary over distance and time. As to the issues of water depth, direction of flow and direction of wave spill, the channel or pool bottoms of Category 2 devices constantly change in depth and become more shallow as one moves in the direction of the traveling wave and released water.

Category 3—a stationary hydraulic jump resulting in a spilling wave. Representative prior art: Le Mehaute U.S. Pat. No. 3,802,697.

Category 4—a moving hydraulic jump caused by a moving hull. Representative prior art: Le Mehaute '697 (supra) also disclosed movement by a wedge shaped body through a non-moving or counter-moving body of water, with such movement causing a hydraulic jump and resultant spilling wave suitable for surf-riding.

Category 5—a wave shape that simulates a stationary unbroken wave. Representative prior art: Frenzl U.S. Pat. No. 3,598,402 issued Aug. 10, 1971 is perhaps more closely related in structure to the shallow water flow embodiments of the present invention than any of the previously discussed references. Frenzl disclosed an appliance for practicing aquatic sports such as surf-riding, water-skiing and swimming comprised of a vat, the bottom of which is upwardly sloping and has a longitudinal section which shows a concavity facing upwards while a stream of water is caused to flow upslope over said bottom as produced by a nozzle discharging water unto the surface of the lower end of said bottom. Provision is made for adjustment of the slope of the vat bottom around a pivotal horizontal axis to permit the appliance to be adjusted for that sport which has been selected for practice, e.g., water skiing reduced slope or surf-riding increased slope. Provision is also made for varying the speed of the water from a "torrential flow" for water skimming activities, e.g., surfboard riding, to a "river type flow" wherein the speed of the water is matched to the speed of an exercising swimmer. However, Frenzl '402 does not recognize, either explicitly or implicitly some of the problems solved and advantages proffered by the present invention.

Frenzl U.S. Pat. No. 4,564,190 issued Jan. 14, 1986 shows improvements to the appliance for practicing aquatic sports using gliding devices (as disclosed in the Frenzl '402 patent) by introduction of a device that removes water from an upwardly sloping bottom surface which has been slowed down by friction at the boundary faces and returns the water to a pumping system to thereby increase the flow rate and thus eliminate the delirious effects of slowed down water. Frenzl U.S. Pat No. 4,905,987 issued Mar. 6, 1990 shows improvements to the appliance disclosed in the Frenzl '402 patent (described above) by showing connected areas for swimming, non-swimming and a whirlpool so that water from the Frenzl '402 appliance is further utilized after outflow thereof. The primary objective of the Frenzl '987 patent is to improve the start and exit characteristics of the Frenzl '402 appliance by providing a means whereby a user can enter, ride, and exit the appliance to avoid breakdown of the torrential flow.

Category 6—a deflective wave shape that simulates a stationary tunnel wave. Representative prior art: Hornung, H. G. and Killen, P., "A Stationary Oblique Breaking wave for Laboratory Testing of Surfboards", journal of Fluid Mechanics (1976), Vol. 78, Part 3, pages 459–484. P. D. Killen, "Model Studies of a Wave Riding Facility", 7th Australasian Hydraulics and Fluid Mechanics Conference, Brisbane, (1980). P. D. Killen and R. J. Stalker, "A facility for Wave Riding Research", Eighth Australasian Fluid Mechanics Conference, University of Newcastle, N.S.W. (1983). The apparatus taught by Killen (all three articles will be collectively referred to as Killen, and each article is specifically referenced by chronological date of publication) forms a wave shape of the type favored by surfboard riders, by placing a suitably shaped fixed position obstacle in a channel of specified width and in the path of a flow of water with specified depth and velocity such that deflection of the water off the obstacle duplicates the geometric and hydrodynamic aspects of a surface gravity wave that is obliquely incident to a sloping beach. At first glance, it may appear that structure as taught by Killen and that as disclosed by the subject invention are substantially similar. However, close examination will reveal significant differences.

In summary, Killen was attempting to create a wave shape that was geometrically and hydrodynamically similar to the ideal wave in the real surfing situation. The "conforming wave shape" as formed by the shallow water flows of the subject invention does not attempt to geometrically and hydrodynamically simulate the ideal wave in the real surfing situation. The "conforming" deep water flows of the subject invention do not require such simulation, even though they can so simulate.

SUMMARY OF INVENTION

To better understand the objects and advantages of the invention as described herein, a list of special terms as used herein are defined:

(1) "deep water flow": that flow whereby the water depth is sufficient such that boundary layer effects of the sheet flow over the forming surface does not significantly influence the operation of rider or riding vehicle, e.g., surfboard. Deep water flow shapes can, assuming certain flow forming and flow characteristics (e.g., velocity) are met, duplicate naturally occurring waves.

(2) "shallow water flow": that flow whereby the water is of such depth that the surface boundary layer effects of the sheet flow over the forming surface significantly influences the operation of rider or riding vehicle, e.g., surfboard. Shallow water flow shapes will never duplicate naturally occurring waves.

(3) "surfing maneuvers": those maneuvers capable of performance on a surfboard which occur under ocean like hydrodynamic conditions, including deep water flows with the appropriate ocean approximating flow characteristics. Surfing maneuvers include riding across the face of the surface of water on a surfboard, moving down the surface toward the lower end thereof, manipulating the surfboard to cut into the surface of water so as to carve an upwardly arcing turn, riding back up along the face of the inclined surface of the body of water and cutting-back so as to return down and across the face of the body of water and the like, e.g., lip bashing, floaters, inverts, aerials, 360's, etc.

(4) "water skimming maneuvers": those maneuvers which can be performed on shallow water flows including "surfing like maneuvers" (i.e., similar to those described in "surfing" maneuvers above) as well as, other activities or other types of maneuvers with differing types of vehicles e.g., inner-tubes, bodyboards, etc.

(5) "body of water": a volume of water wherein the flow of water comprising that body is constantly changing, and with a shape thereof at least of a length, breadth and depth sufficient to permit surfing or water skimming maneuvers thereon as limited or expanded by the respective type of flow, i.e., deep water or shallow water.

(6) "conform (conformed, conforming)", where the angle of incidence of the entire depth range of a body of water is (at a particular point relative to the inclined flow forming surface over which it flows) predominantly tangential to said surface. Consequently, water which flows upon an inclined surface can conform to gradual changes in inclination, e.g., curves, without causing the flow to deflect. As a consequence of flow conformity, the downstream termination of an inclined surface will always physically direct and point the flow in a direction aligned with the downstream termination surface. A conformed water flow is a non-separated water flow and a deflected water flow is a separated water flow, as the terms separated and non-separated are known by those skilled in the art.

(7) "equilibrium zone": that portion of an upwardly inclined body of water wherein a rider is in equilibrium depending on the one hand, on an upwardly directed force ascribable to the drag or resistance of the riders vehicle or body dipped into the stream of water and, on the other hand, on a downwardly directed force produced by the component of the weight of the rider in a direction parallel with the inclined water forming means.

(8) "supra-equidyne area": that portion of a body of water above the equilibrium zone wherein the slope of the incline is sufficiently steep to enable a rider to overcome the upwardly sheeting water flow and slide downwardly thereupon.

(9) "sub-equidyne area": that portion of a body of water below the equilibrium zone that is predominantly horizontal. In the sub-equidyne area a rider cannot achieve equilibrium and will eventually (due to the forces of fluid drag) be moved back up the incline.

One object of the present invention is to improve upon the parent invention by providing a flow forming surface upon which a shallow water flow can produce a body of water that is similar to the kind prized by surfers, i.e., a tunnel wave, which has a mouth and an enclosed tunnel extending for some distance into the interior of the forward face of the wave-shape. Such improvement is hereinafter referred to as the "Shallow Flow Tunnel Wave Generator." Heretofore, tunnel waves have only been available to surfers in a natural or deep water flow environment. The subject invention, through proper configuration of a flow forming surface and adequate shallow water flow characteristics (e.g., velocity, turbidity, depth, direction, etc.), can produce wave forms that have similar appearance and ride characteristics as "real" tunnel waves subject to certain ride conditions, e.g., limitation on surfboard fin size. However, the significant cost savings attributive to shallow flow construction and reduced energy consumption outweigh any limitations that may be imposed.

The parent invention also provided for a stationary non-breaking upwardly inclined deep water flow shape for beginners. The subject invention will also improve upon this embodiment of the parent invention through the use of shallow water flow technology. Such improvement is hereinafter referred to as the "Shallow Flow Inclined Surface." In addition to the significant advantage or reduced cost, additional advantages to the shallow water improvements described above include, increased safety due to reduced deep water pool depth, reductions in water maintenance due to decrease in volume of water treated, and the opportunities to create novel water sports, e.g., flowboarding or inner-tube "bumper cars".

A second object of the subject invention is to provide a flow forming means (hereinafter referred to as the "Connected Structure") comprised of a substantially horizontal flat surface (the sub-equidyne area) that transitions by way of a radial concave arc (the equilibrium zone) connected to the supra-equidyne area (e.g., the inclined plane or tunnel wave generator). The Connected Structure facilitates a riders ability to maximize his forward speed by the riders own efforts of "pump-turning", hereinafter more fully described as the "Acceleration Process". Without benefit of said Connected Structure such increased speed would not be available. The Connected Structure encompasses the complete spectrum of surface flows and wave shapes desired by wave-riding and water skimming enthusiasts. Beginning at one extreme with a flat incline, and progressing by introduction of an increasing array of surface curvatures from the horizontal to the vertical combined with varying attitude and inclination of said surface relative to an upward (or downward, as the case may be) flow of water that culminates at the other extreme in a tunnel wave shape. A significant feature of the Connected Structure is how its unique configuration can dramatically improve the performance parameters of the parent invention's inclined Surface embodiment. The parent invention hereto permitted conventional surfing maneuvers; however, its structure did not optimally facilitate the generation of forward speed with which to perform such maneuvers. The "Acceleration Process" as now enabled by the Connected Structure improvement allows such forward speed to be attained.

A third object of the subject invention is to solve the transient surge problems associated with the ride start-up and rider induced flow decay upon upwardly inclined flow surfaces. This solution results by lowering the downstream boundary area of the inclined flow forming surface at an angle so as to create a maximum height ridge line of decreasing elevation to facilitate self-clearing of undesirable transitory surges. This improvement is hereinafter referred to as the "Self-Clearing Incline."

A fourth object of the subject invention and a novel ramification to the "Self-Clearing Incline" occurs by extending the inclined flow forming surface and associated ridge line of the downstream boundary area to an increased elevation. If such increase in elevation is in excess of the net total head flow necessary to scale this new increase in elevation, then the flow will form a hydraulic jump and the sub-critical water thereof will spill down the upwardly sheeting flow in the manner of a spilling wave. This improvement is hereinafter called the "Inclined Riding Surface with Spilling Wave"). The spilling wave phenomena can also be incorporated into the other embodiments as described herein. A corollary improvement to any spilling wave application is a properly configured vent system to handle the water which spills back down the flow forming surface. If such water remained unvented, it would eventually choke the entire flow. Consequently, to maintain a steady state condition, to the extent that new water flows into the system, then, an equal amount of old water must vent out.

A fifth object of the subject invention is to improve by way of combination the tunnel and inclined flow forming surfaces, as well as, creation of an intermediate "spilling wave" that works in combination with the inclined flow surface. This embodiment is hereinafter referred to as the "Omni-Wave". A feature of the Omni-Wave embodiment is its unique flow forming shape can permit (by way of a progressive increase of the net head of the sheet flow) the transformation of a sheet of water flow from a stationary "spilling wave" along the entire forming means, to a transitional "spilling wave" with inclined surface flow, to the final inclined surface flow and tunnel wave shape. This method is hereinafter referred to as the "Wave Transformation Process". The Omni-Wave and the Wave Transformation Process will offer an improved environment for the performance of surfing and water skimming maneuvers.

A sixth object of the present invention is to provide an apparatus that will enable riders to perform surfing and water skimming maneuvers in a format heretofore unavailable except by analogy to participants in the separate and distinct sports of skateboarding and snowboarding, to wit, half-pipe riding. In this regard, the present invention comprises a method and apparatus for forming a body of water with a stable shape and an inclined surface thereon substantially in the configuration of a longitudinally oriented half-pipe. Such improvement is hereinafter referred to as the "Fluid Half-Pipe." A corollary improvement to the Fluid Half-Pipe is to provide an apparatus that permits an increased throughput capacity by increasing the depth of the Fluid Half-Pipe in the direction of its length. This increase in depth will have the added benefit of causing a rider to move in the direction of fall and facilitate his course through the ride.

The final object of the present invention is the positioning of dividers within a Fluid Half-Pipe or Inclined Surface as described above and to prevent a "jet wash" phenomenon that can result in loss of a rider's flow. This "jet wash" phenomenon occurs when a rider who is positioned in the equilibrium or supra-equidyne area of a thin sheet flow gets his flow of water cut off by a second rider positioned with priority to the line of flow. The cutting off of water occurs in thin sheet flow situations due to the squeegee effect caused by the second rider's skimming vehicle. The improvement aids in preventing adjacent riders from cutting off their respective flows of water. Such improvement is hereinafter referred to as "Sheet Flow Dividers."

Other objectives and goals will be apparent from the following description taken in conjunction with the drawings included herewith.

BRIEF DESCRIPTION OF THE DRAWINGS

FIG. 12 is a contour map of the Self-Clearing Tunnel Wave.

FIG. 14*a* and FIG. 14*b* illustrate in time lapse sequence the self-clearing Tunnel Wave.

DETAILED DESCRIPTION OF HE SUBJECT INVENTION

Because the original application, the continuation of the original application and the subject invention are operated in water, and many of the results of its passage there-through, or the propelling of water against the wave or flow forming means thereof, are similar to those caused by a boat hull, some of the terms used in the descriptions hereto will be nautical or marine terms; likewise, from the perspective of physical water dynamics, some of the terms used herein will be hydraulic engineering terms; and finally, from the perspective of ride operation and function, some of the terms used herein will be terms as used in the sport of surfing; all such terms constitute a ready-made and appropriate vocabulary which is generally understood by those skilled in the art. To the extent that there are special terms, then, those terms are further defined herein.

Further, it will be understood by those skilled in the art that much of the description of structure and function of the wave generator and inclined surface of the original application and its continuation application may apply to the embodiments of the subject invention, to the extent used by this application, Therefore, the descriptions of the flow forming means/wave generator hull and inclined surface of the prior applications should also be read in conjunction with FIGS. 1–20. However, to the extent there are any differences or discrepancies between the description and teaching of the prior applications and the subject invention, the description and teaching of the subject invention shall prevail.

Except where specifically limited, it is to be understood that the embodiments as described herein are to function in both deep and shallow flow environments. Furthermore, that the flow (except where noted) is to be super-critical (i.e., according to the formula $v>\sqrt{gd}$ where v =velocity, g=acceleration due to gravity ft/sec$^2$, d=depth of the sheeting body of water).

Description of Shallow Flow Tunnel "Wave" Generator

Figure 1:
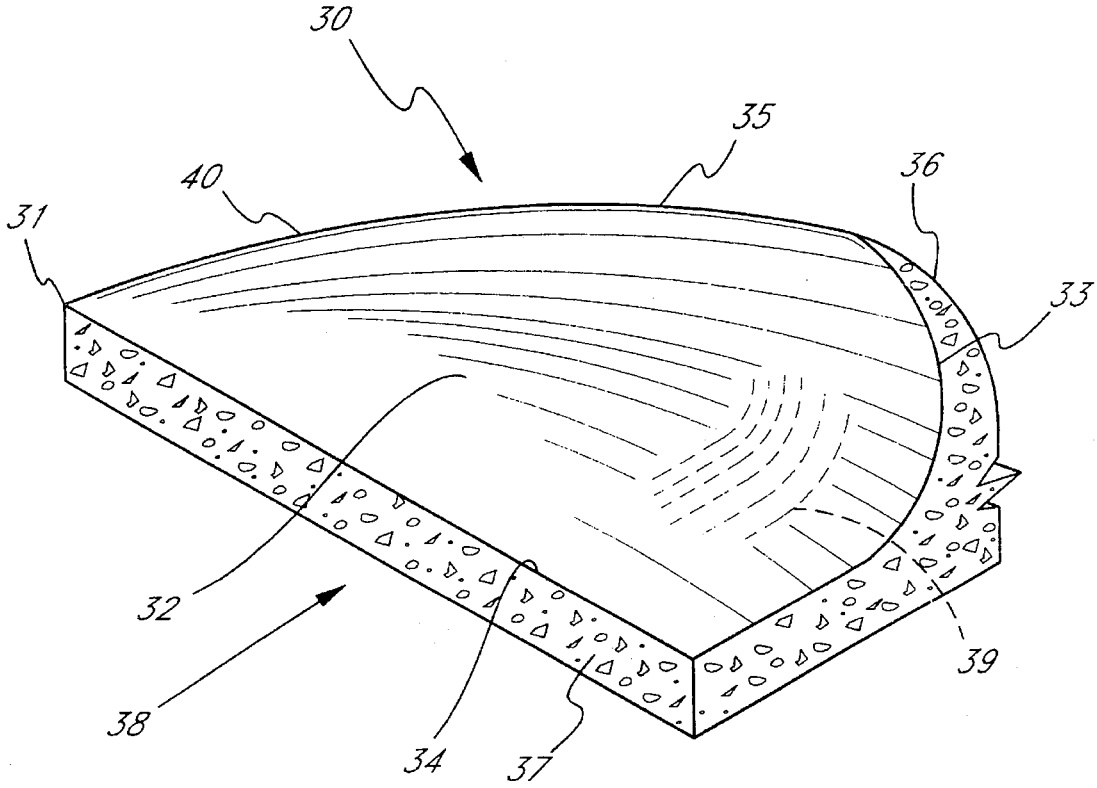
FIG. 1 is a profile view of a Tunnel "Wave" Generator configured for shallow waterflows.
Figure 2:
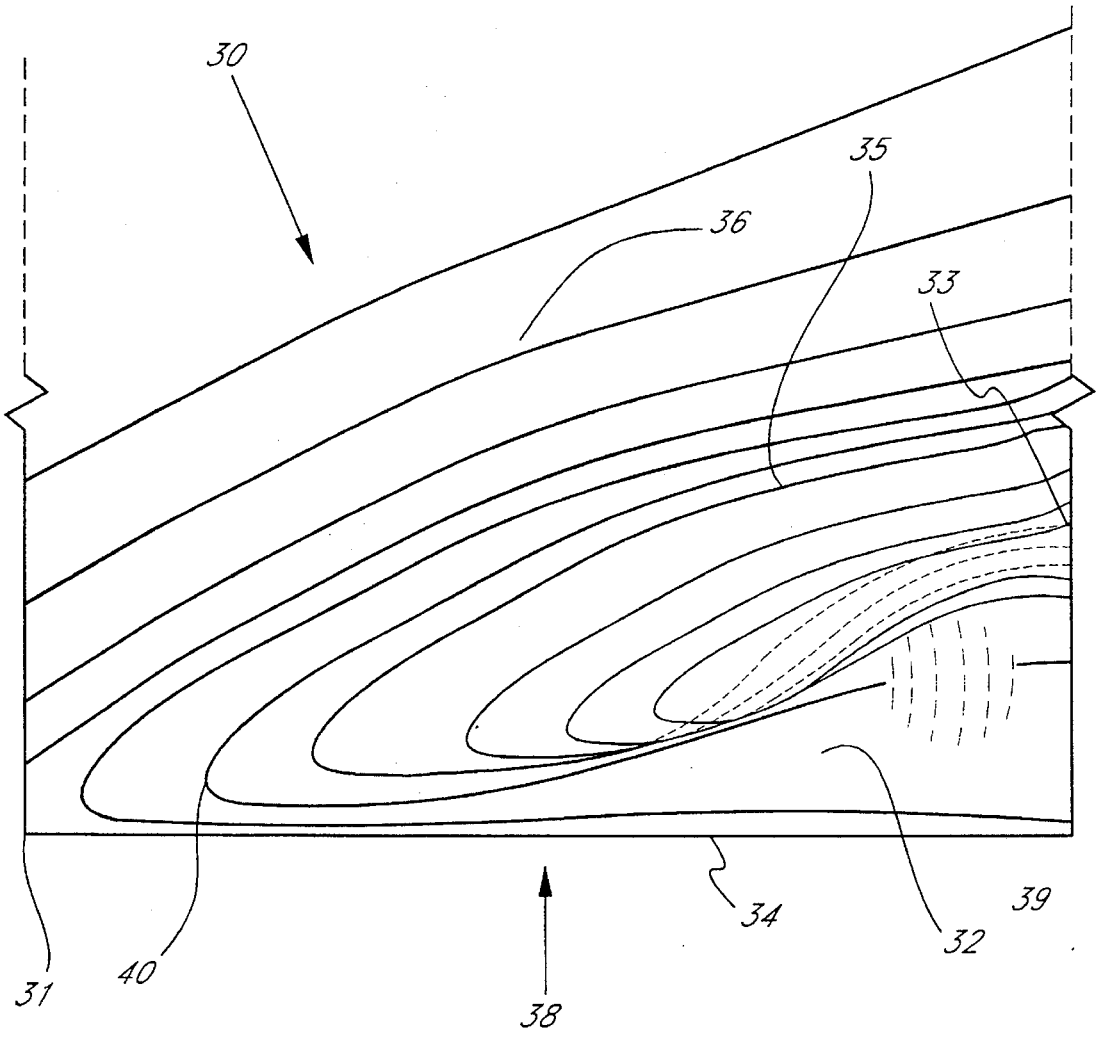
FIG. 2 is a contour map of Tunnel "Wave" Generator as set forth in FIG. 1.

Turning now to FIG. 1 (isometric view) and FIG. 2 (contour map) there is illustrated a Tunnel "Wave" Generator 30 similar to the generator of prior application, however, improved to serve in a shallow water flow. Plan-sectional lines as revealed in FIG. 1 and contour lines as revealed in FIG. 2 are solely for the purpose of indicating the three-dimensional shape in general, rather than being illustrative of specific frame, plan, and profile sections. Tunnel Generator 30 is comprised of a stem 31, a front face 32, a stern arch 33, an upstream edge 34 running from stem 31 to stern arch 33 and acting as the upstream perimeter of front surface 32, a downstream edge 35 running from stem 31 to stern arch 33 and acting as the downstream perimeter of front face 32, back surface 36, and sub-surface structural support 37. Front surface 32, bounded by upstream edge 34, downstream edge 35 and stern arch 33 is that feature of Tunnel Generator 30 which effectively shapes its tunnel "wave." Moving in a direction as indicated by arrow 38, supercritical shallow water flow 39 originating from a water source (not shown) moves in a conforming flow upward over the front face 32 to form an inclined body of water in the shape of a tunnel "wave" (not shown) upon which a rider (not shown) can ride. Back surface 36 is sufficiently smooth and with transitions analogous to a conventional waterslide such that a rider (not shown) could safely be swept over or around Tunnel Generator 30 to a termination pool or area (not shown) to properly exit. The outside dimensions of the flow forming front face 32 of Tunnel Generator 30 are capable of a broad range of values which depend more upon external constraints, e.g., financial resource, availability of water flow, etc., rather than specific restrictions on the structure itself. However, for purposes of scale and not limitation, in order to form a tunnel "wave" of adequate size to fully accommodate an adult user, the outside dimensions of Tunnel Generator 30 should be approximately 1 to 3 meters in height and 3 to 12 meters in length.

Figure 3:
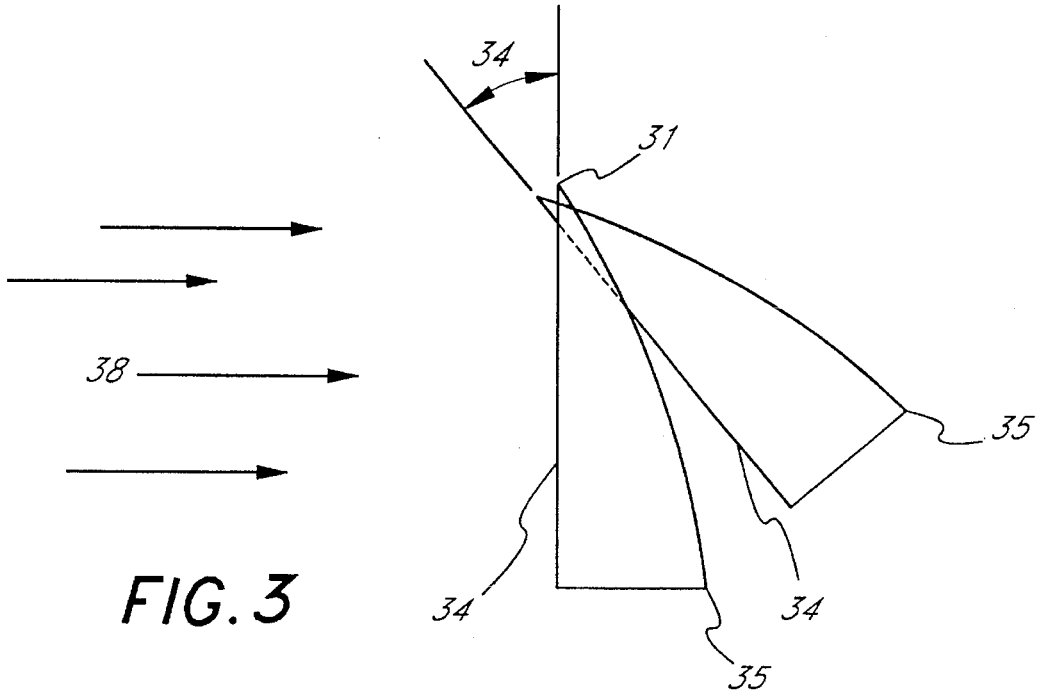
FIG. 3 is a plan view of the range of horizontal attitude with respect to the direction of water flow that the wave generator (as set forth in FIG. 1) can take and still form a tunnel wave.
Figure 4:
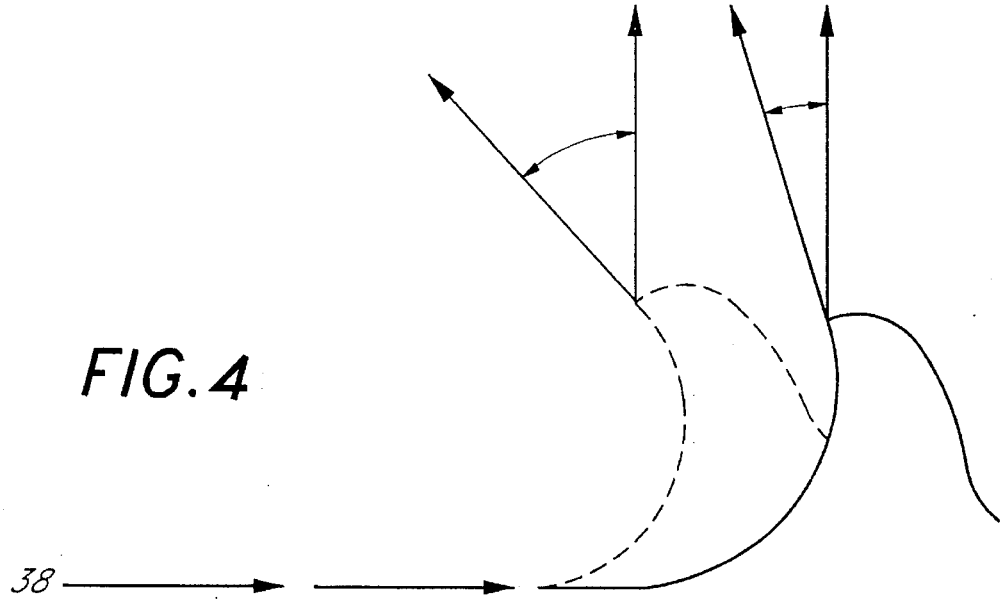
FIG. 4 is a view in profile of a typical cross-section disclosing the range of inclination of the forward face of the wave generator (as set forth in FIG. 1) with respect to the direction of water and orientation to the vertical.

At least three characteristics of front face 32 of Tunnel Generator 30 influence the size, shape and angle of the tunnel "wave," and each of them interacts with the others:

A. its shape (FIG. 1 and 2);

B. its attitude—its horizontal position or angle with respect to the direction of water flow (FIG. 3); and C. its inclination—its vertical position or angle with respect to the direction of water flow (FIG. 4). Each characteristic of front face 32 is now discussed in detail.

A. Shape

Front face 32 of Tunnel Generator 30 has a complex shape comprised of concave curvature, both vertically and horizontally, as indicated generally by the FIG. 1 plan sections lines and FIG. 2 contour lines. Such lines are substantially but not specifically illustrative of the range of possible shapes, as will now be explained more fully:

1. Vertically:
   a. the shape of the vertical curvature can be:
      (1) substantially a simple arc of a circle; or
      (2) preferably an arc of a more complex changing curve, e.g.:
         (a) ellipse;
         (b) parabola;
         (c) hyperbola; or
         (d) spiral.

If a changing curve, it preferably changes from an opening curve (i.e., the ascending water encounters an increasing radius as it ascends front face 32) at stem 31 through a transition point 40; to a closing curve (i.e., the ascending water encounters a decreasing radius as it ascends front face 32) from transition point 40 to stern arch 33. A critical feature of Tunnel Generator 30 is that commencing at transition point 40, front face 32 begins to curve past the vertical. Curvature past the vertical from transition point 40 towards the stern arch 33 gradually increases from 0 to a maximum of 30 degrees. 10 degrees if preferred.

2. Horizontally
   a. The shape of the horizontal curvature can be:
      (1) substantially an arc of a circle; or
      (2) preferably, a portion of a more complex, changing, curve, e.g.:
         (a) ellipse;
         (b) parabola;
         (c) hyperbola; or
         (d) spiral.

B. Attitude

As disclosed in FIG. 3, the horizontal attitude of front face 32 with respect to direction 38 of water flow can vary only within certain limits otherwise the "tunnel" will not develop. Since front face 32 has concave curvature of varying degrees along its horizontal axis, for purposes of orientation an extension of upstream edge 34 is used to indicate varying horizontal attitudes of front face 32 therefrom. Accordingly, upstream edge 34 can vary from substantially perpendicular to the direction 38 of water flow to an angle of approximately 35 degrees, as shown.

C. Inclination

As disclosed in FIG. 4, the inclination of the front face 32 with respect to the direction 38 of water flow is also limited, otherwise the tunnel will not be developed. Two factors are important with respect to inclination, first, the change in angle of incline relative to the depth of the water must be sufficiently gradual to avoid separation of flow lines/deflection. Second, the angle of release (as defined by a line tangent to front face 32 at downstream edge 35 when compared to the vertical) must be past the vertical as shown. Amounts past vertical may vary, however, a preferred amount is 10 degrees.

At least two other factors effect the size and shape of tunnel wave formation, i.e., flow velocity and water flow depth. The velocity of the water over Tunnel Generator 30 has a wide range, dependent upon the overall size of the Tunnel Wave Surface and the depth of water. In general, the flow is to be super-critical (i.e., according to the formula $v>\sqrt{gd}$ where v=velocity, g=acceleration due to gravity ft/sec$^2$, d=depth of the sheeting body of water). However, velocities in excess of that which is at a minimum necessary to achieve supercritical velocity are sometimes desired, e.g., to provide sufficient momentum transfer to support the weight component of a given rider, and to achieve the vertical heights required to form a tunnel "wave."

The depth of the water is primarily a function of the minimum necessary to permit a tunnel "wave" to form at a given height, and simultaneously enable the flow of water to support (via momentum transfer) the weight component of a contemplated range of users. Because of the operational requirements of momentum transfer, the depth of the water has direct relationship to the velocity of the water, i.e., the higher the velocity of flow, the lower the requisite depth. Since this embodiment is limited to shallow flows, the depth of water will range from approximately 2 to 40 centimeters.

Tunnel Generator 30 can be fabricated of any of several of well known materials which are appropriate for the use intended. Concrete; formed metal, wood, or fiberglass; reinforced tension fabric; air, foam or water filled plastic or fabric bladders; or any such materials which will stand the structural loads involved. A preferred embodiment includes a thick foamed plastic covering to provide additional protection for the riders using the facility.

Theoretically, no pool or water containment means is required for Tunnel Generator 30, in that the flow from a suitable flow source (e.g., pump and nozzle, fast moving stream or elevated reservoir/lake) is all that is required. However, where water recycling is preferred, then, low channel walls can be constructed to retain the flowing water with a lower collection pool, recycling pump and appropriate conduit connected back to the upstream flow source. The area of channel containment need be only large enough to allow the performance of appropriate water skimming maneuvers, since the curling water of the tunnel wave would remain more or less stationary with respect to the containment structure. Thus, such a structure could be constructed even in a backyard.

From the description above, a number of advantages of Tunnel "Wave" Generator 30 becomes evident:

(a) The energy required to produce a tunnel "wave" shape under shallow flow conditions is dramatically less than that required under "natural" conditions, e.g., as indicated in Killen's 1980 article, the power required to produce operational natural waves is proportional to the height of the wave raised to the 3.5 power ($hw^{3.5}$). Consequently, a 2 meter wave would require 11.3 times the power of a 1 meter wave or approximately 3.7 mega watts or 4800 horsepower. An 8 cm in depth shallow flow wave as contemplated by the subject invention with similar width to Killen's structure would be able to produce a 2 meter high tunnel "wave" for under 400 horsepower.

(b) The capital costs and operating costs for shallow water tunnel "wave" generation is substantially less than deep water installations.

(c) The sight, sound, and sensation of tunnel "wave" riding is a thrilling participant and observer experience, that has heretofore only been available to relatively few people in the world. The subject invention will enable this experience to become more readily available.

(d) From a safety perspective, shallow water is generally perceived as safer in view of drowning.

Operation of the Tunnel "Wave" Generator

Figure 5:
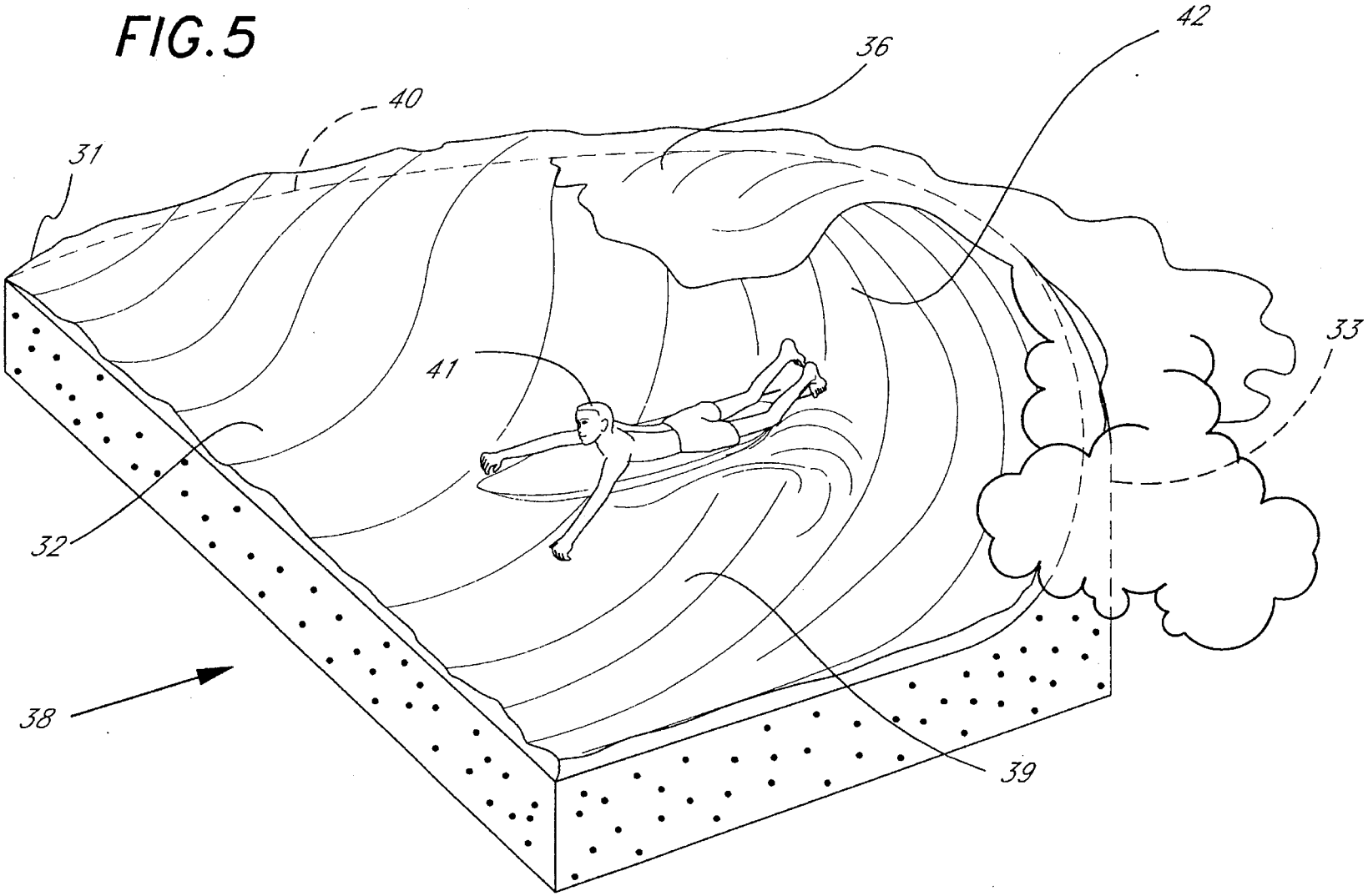
FIG. 5 depicts a rider on the Tunnel Wave Generator.

FIG. 5 illustrates Tunnel Generator 30 in operation with the concavity of front face 32 acting to shape a water walled tunnel from super-critical shallow water flow 39 within and upon which rider 41 can ride. Water flow 39 originating from a water source (not shown) moves in a direction 38 as indicated. At stem 31 water flow 39 moves over front face 32 and onto back surface (not shown). Back surface (not shown) is sufficiently smooth and with transitions analogous to a conventional waterslide such that rider 41 could safely be swept over or around Tunnel Generator 30 to a termination pool or area (not shown) to properly exit. Progressing from transition point 40 to stern arch 33 the horizontal and vertical concavity of front face 32 acts as a scoop to channel and lift water into the central portion of front face 32 towards stern arch 33. Combined with the attitude of Tunnel Generator 30 relative to the direction 38 of water flow 39, the resultant forces thereto propel water flow 39 along the path of least resistance which is upward and outward creating the desired tunnel 42. Tunnel 42 size is adjustable depending upon the velocity of water flow 39, i.e., the higher the flow velocity the larger the tunnel effect. The forward force component required to maintain rider 41 (including any skimming device that he may be riding) in a stable riding position and overcome fluid drag is due to the downslope component of the gravity force created by the constraint of the solid flow forming surface balanced primarily by momentum transfer from the high velocity upward shooting water flow 39. Rider's 41 motion upslope (in excess of the kinetic energy of rider 41) consists of the force of the upward shooting water flow 39 exceeding the downslope component of gravity. Non-equilibrium riding maneuvers such as cross-slope motion and oscillating between different elevations on the "wave" surface are made possible by the interaction between the respective forces as described above and the use of the rider's kinetic energy.

Accordingly, it should now be apparent that Tunnel "Wave" Generator 30 embodiment of this invention can use shallow water flow in a water ride attraction to simulate ocean tunnel waves. In addition, Tunnel "Wave" Generator 30 has the following advantages:

it requires a fraction of the energy utilized in generating a "real" wave;

it costs substantially less to build and maintain;

it allows a rider to experience the sight, sound, and sensation of tunnel wave riding, an experience that heretofore has not been available in commercial settings;

it uses shallow water which is inherently safer than deep water in the prevention of drowning.

Description of Shallow Flow Inclined Surface

Figure 6:
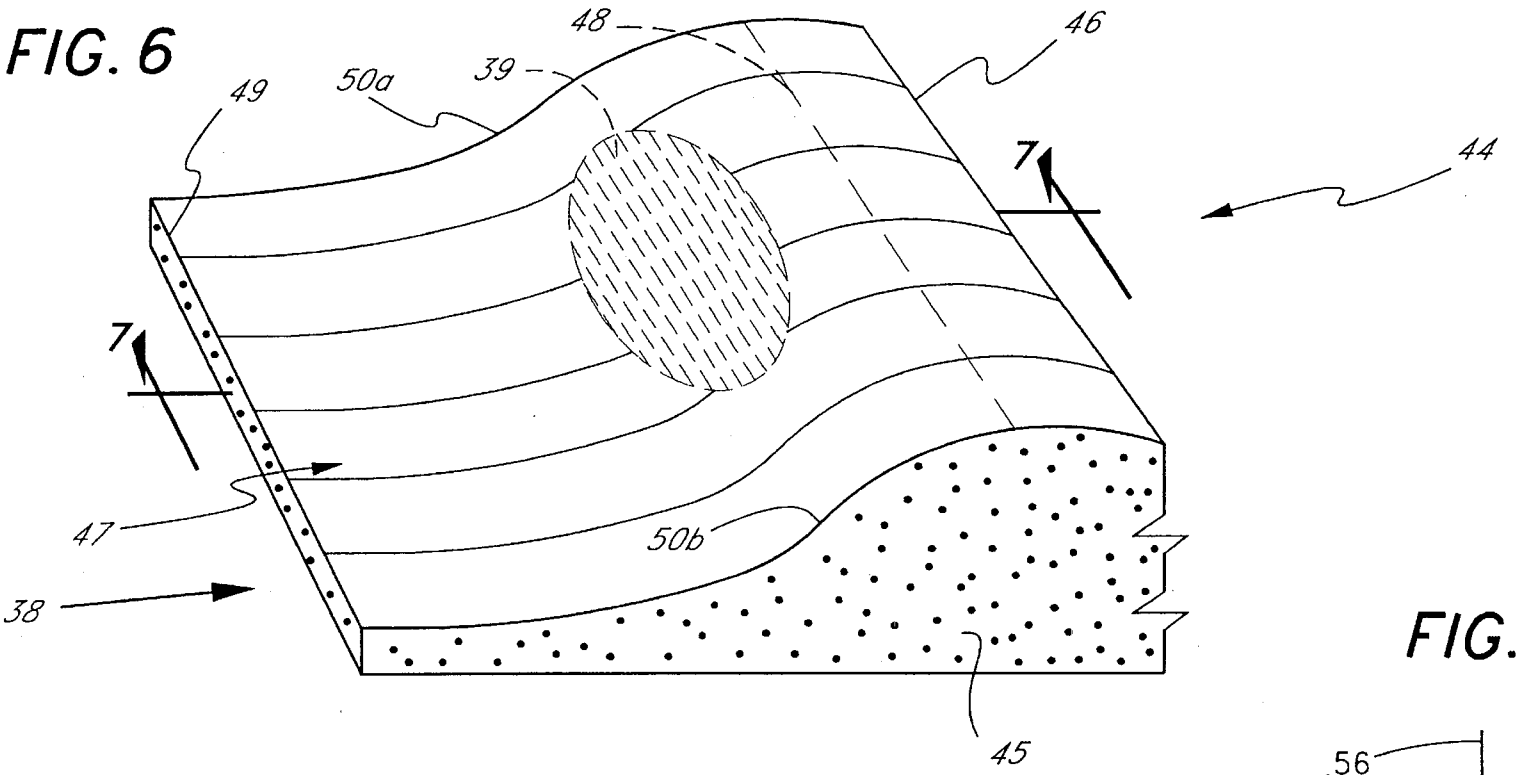
FIG. 6 is a profile view of the inclined surface.
Figure 7:
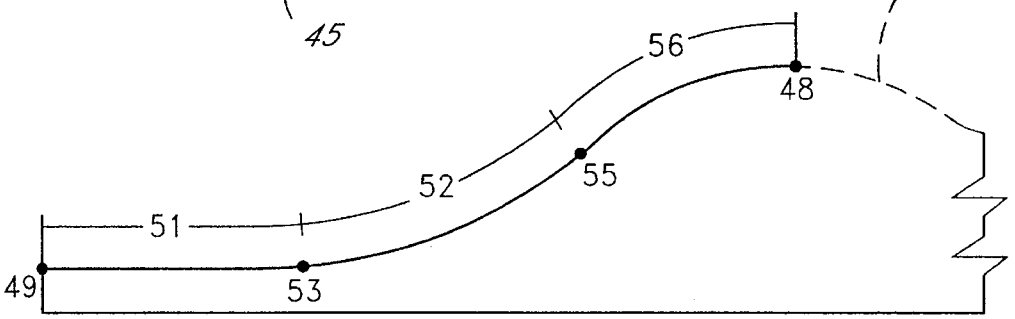
FIG. 7 is a cross-sectional view of the inclined surface as shown in FIG. 6.

Turning now to FIG. 6, there is illustrated shallow flow inclined surface 44. Plan-sectional lines as revealed in FIG. 6 are solely for the purpose of indicating the three-dimensional shape in general, rather than being illustrative of specific frame, plan, and profile sections. Shallow flow inclined surface 44 is comprised of sub-surface structural support 45; back surface 46; and front face 47 which is bounded by an imaginary downstream ridge line 48, an upstream edge 49, and side edge **50*a* and 50*b*. Side edge 50 can have walls (not shown) or be connected with conventional broad surfaced downhill sliding transitions (not shown) to either contain or allow a rider to move out and off of the flow. Front face 47 can either be a gradual sloping inclined plane, a continuous concave planar surface, a concave planar surface joined to a convex planar surface, or preferably a combination of planar curved surfaces and planar inclined surfaces. FIG. 7 shows in cross-section a preferred profile of front face 47 with upstream edge 49 (indicated as a point in this cross-sectional view) as the upstream boundary and with a combination of curves and straight inclines as follows: concave curvature 51 as one moves upwards towards the downstream ridge 48 (indicated as a point in this cross-sectional view); concave curvature 51 transitioning to a straight incline 52 at a concave/straight transition point 53; straight incline 52 continuing to straight/convex transition point 55; and convex curvature 56 from straight/convex transition point 55 to downstream ridge 48. Back surface 46 joins front face 47 at the downstream ridge line 48. Back surface 46 is sufficiently smooth and with transitions analogous to a conventional waterslide such that a rider (not shown) could safely be swept over downstream ridge line 48 to a termination pool or area (not shown) to properly exit. Turning back to FIG. 6, super critical water flow 39 originating from a water source (not shown) moves in direction 38 to produce a conforming upward flow over front face 47, the downstream ridge line 48 and onto the back surface 46 to form an inclined body of water upon which a rider (not shown) can ride. The outside dimensions of the flow forming front face 47 of shallow flow inclined surface 44** are capable of a broad range of values which depend more upon external constraints, e.g., financial resource, availability of water flow, etc., rather than specific restrictions on the structure itself.

The velocity of the water over shallow flow inclined surface 44 has a wide range, dependent upon the overall size of the inclined surface and the depth of water. In general, the flow is to be super-critical (i.e., according to the formula $v>\sqrt{gd}$ where v=velocity, g=acceleration due to gravity ft/sec$^2$, d=depth of the sheeting body of water). However, velocities in excess of that which is at a minimum necessary to achieve super-critical velocity are sometimes desired, e.g., to provide sufficient momentum transfer to support the weight component of a given rider, and to achieve the vertical heights required to form an unbroken "wave."

The depth of the water is primarily a function of that which is necessary to successfully operate for the purposes intended. Because of the operational requirements of momentum transfer, the depth of the water has direct relationship to the velocity of the water, i.e., the higher the velocity of flow, the lower the requisite depth. Since this embodiment is limited to shallow flows, the depth of water will range from approximately 2 to 40 centimeters.

Shallow flow inclined surface 44 can be fabricated of any of several of well known materials which are appropriate for the use intended. Concrete; formed metal, wood or fiberglass; reinforced tension fabric; air, foam or water filled plastic or fabric bladders; or any such materials which will stand the structural loads involved. A preferred embodiment includes a thick foamed plastic covering to provide additional protection for the riders using the facility.

Theoretically, no pool or water containment means is required for shallow flow inclined surface 44, in that the flow from a suitable flow source (e.g., pump and nozzle, fast moving stream or elevated reservoir/lake) is all that is required. However, where water recycling is preferred, then, low channel walls can be constructed to retain the flowing water with a lower collection pool, recycling pump and appropriate conduit connected back to the upstream flow source. The area of channel containment need be only large enough to allow the performance of appropriate water skimming maneuvers. Thus, such a structure could be constructed even in a back yard.

From the description above, a number of advantages of Shallow Flow Inclined Surface 44 becomes evident:

(a) The energy required to produce an unbroken "wave" shape similar to that simulated by Shallow Flow Inclined Surface 44 is dramatically less than that required under "natural" conditions, e.g., as indicated in Killen's 1980 article, the power required to produce operational natural waves is proportional to the height of the wave raised to the 3.5 power ($hw^{3.5}$). Consequently, a 2 meter wave would require 11.3 times the power of a 1 meter wave or approximately 3.7 mega watts or 4800 horsepower. An 8 cm in depth shallow flow wave as contemplated by the subject invention with similar width to Killen's structure would be able to produce a 2 meter high inclined surface "wave" for under 400 horsepower.

(b) The capital costs and operating costs for shallow water inclined surface "wave" generation is substantially less than deep water installations.

(c) The sight, sound, and sensation of inclined surface "wave" riding is a thrilling participant and observer experience, that has heretofore only been available to relatively few people in the world. The subject invention will enable this experience to be become more readily available.

(d) From a safety perspective, shallow water is generally perceived as safer in view of drowning.

Operation of Shallow Flow Inclined Surface

Figure 8:
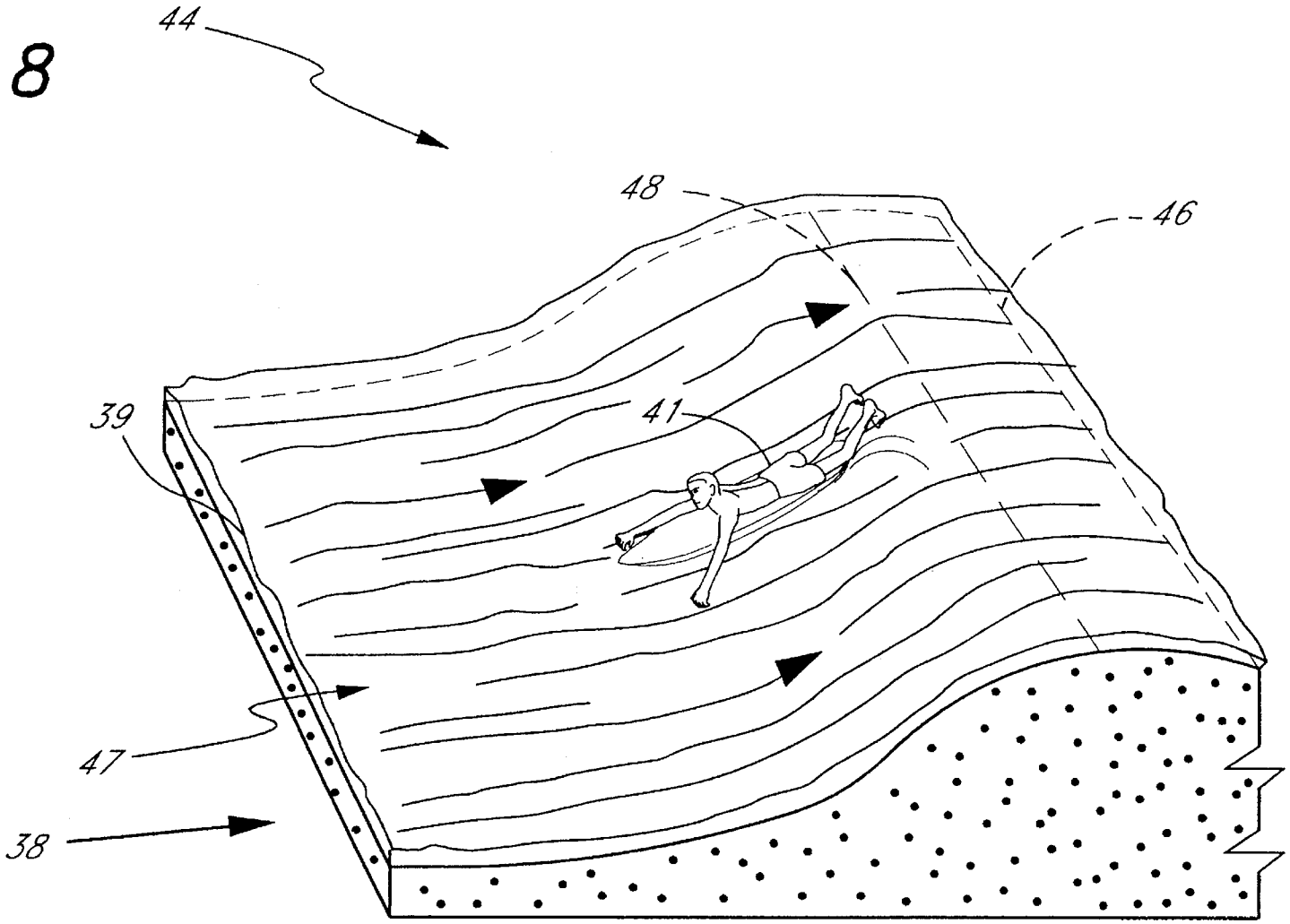
FIG. 8 depicts a rider on the Inclined Surface.

FIG. 8 illustrates Shallow Flow Inclined Surface 44 in operation. Super-critical water flow 39 originating from a water source (not shown) moves in direction 38 to produce a conforming upward flow over front face 47, the downstream ridge line 48 and onto the back surface 46 to form an inclined body of water upon which rider 41 can ride. Front face 47 serves as the primary riding area for rider 41. On this area rider 41 will be able to perform skimming maneuvers as follows: The forward force component required to maintain rider 41 (including any skimming device that he may be riding) in a stable riding position and overcome fluid drag is due to the downslope component of the gravity force (created by the constraint of sub-surface structural support 45) balanced primarily by momentum transfer from the high velocity upward shooting water flow 39. The motion of rider 41 in an upslope direction (in excess of the kinetic energy of rider 41) consists of the force of the upward shooting water flow 39 exceeding the down slope component of gravity. Non-equilibrium riding maneuvers such as cross-slope motion and oscillating between different elevations on the "wave" surface are made possible by the interaction between the respective forces as described above and the use of rider's 41 kinetic energy. Back surface 46 is sufficiently smooth and with transitions analogous to a conventional waterslide such that rider 41 could safely be swept over downstream ridge line 48 to a termination pool or area (not shown) to properly exit.

Accordingly, it should now be apparent that Shallow Flow Inclined Surface 44 embodiment of this invention can use shallow water flow in a water ride attraction to simulate unbroken ocean waves. In addition, Shallow Flow Inclined Surface 44 has the following advantages:

it requires a fraction of the energy utilized in generating a "real" wave;

it costs substantially less to build and maintain;

it allows a rider to experience the sight, sound, and sensation of continuous unbroken wave riding, an experience that hereto for has not been available in commercial settings. Such capability will greatly expand the training of beginning "surf-riders" and provide a venue for surf-camps, etc.

it uses shallow water which is inherently safer than deep water in the prevention of drownings.

Description of Connected Structure

The Connected Structure creates additional surface area beyond the areas defined by Tunnel Wave Generator 30 and Shallow Flow Inclined Surface 44. In general terms, this expanded area can be described as a horizontal area upstream of the upstream edge of each respective embodiment. Furthermore, the Connected Structure describes specific ratios between three distinct regions that can be defined to exist on Tunnel Wave Generator 30 and Shallow Flow Inclined Surface 44 as improved by the Connected Structure. Through combination of area expansion and defined region size relationship, a flow forming means can be described with performance characteristics as yet undisclosed by the prior art.

Figure 9A:
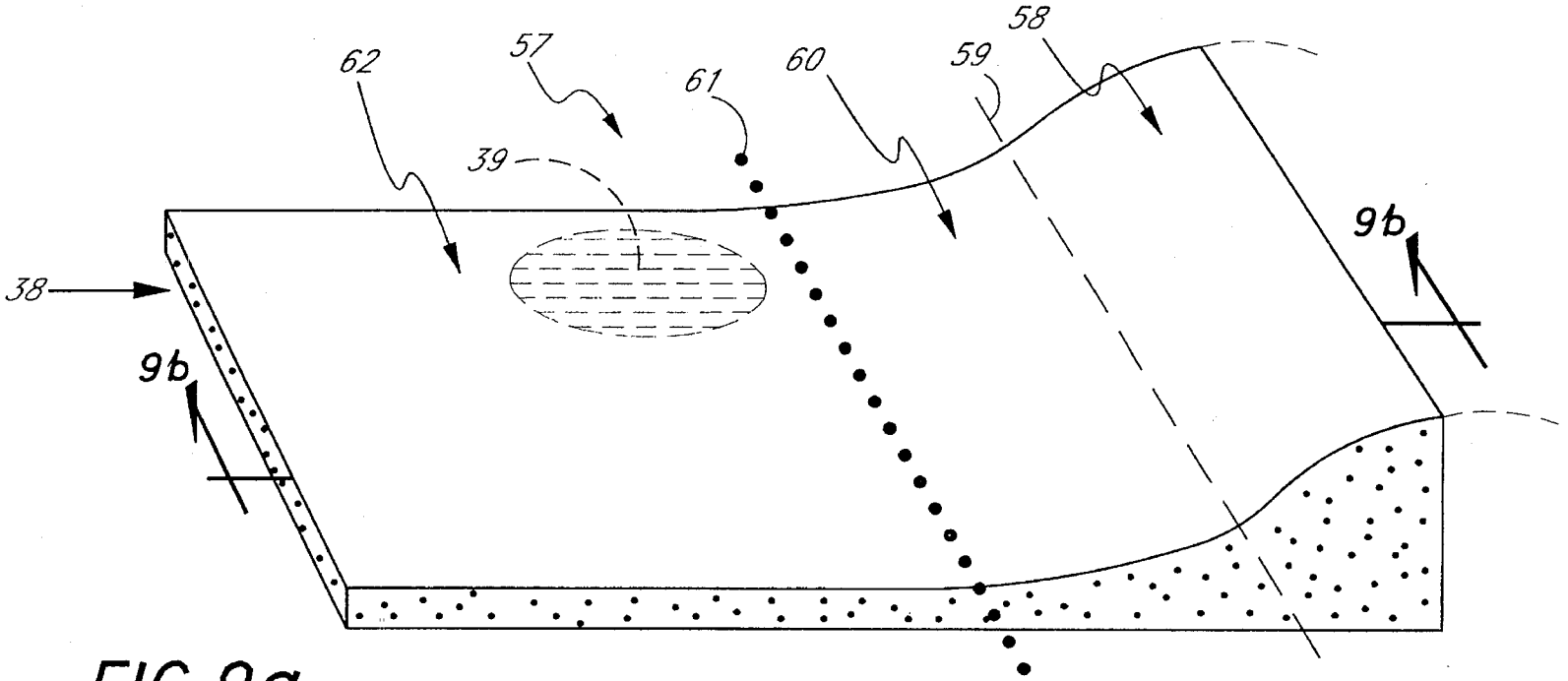
FIG. 9*a* is a profile view of the Connected Structure.

Turning now to FIG. **9*a*, we see a generalized diagram of an improvement for a flow forming means herein called Connected Structure 57. Plan-sectional lines as revealed in FIG. 9*a* are solely for the purpose of indicating the three-dimensional shape in general, rather than being illustrative of specific frame, plan, and profile sections. Connected Structure 57 is comprised of a supra-equidyne area 58 which transitions (as represented by a dashed line 59) to an equilibrium zone 60, which in turn transitions (as represented by a dotted line 61) to a sub-equidyne area 62. The dimensions and relationship of Connected Structure's 57 sub-equidyne 62, equilibrium 60, and supra-equidyne 58** areas are described as follows:

FIG. **9*b* illustrates a cross-section of Connected Structure 57, with sub-equidyne area 62, equilibrium zone 60, and supra-equidyne area 58 with a range of configurations 58*a*, 58*b*, and 58*c*** that are capable of producing a flow that ranges from the previously described unbroken "wave" (i.e., inclined flow) and the tunnel "wave" flow.

The preferred embodiment for the breadth of the sub-equidyne area 62 in the direction of flow 38 is, at a minimum, one and one half to four times the vertical height (as measured from sub-equidyne to the top of supra-equidyne) of the total flow forming means. The large breadth would apply to low elevation means (e.g., 1 meter) and smaller breadth to high elevation means (e.g., 6 meters). Sub-equidyne 62 orientation is substantially horizontal and normal to the force of gravity.

The preferred embodiment for the shape of equilibrium zone 60 can be defined by a portion of a changing curve, e.g., an ellipse; parabola; hyperbola; or spiral. If a changing curve, the configuration of equilibrium zone 60 is substantially arcs of a closing curve (i.e., the ascending water encounters a decreasing radius as it ascends the face of the flow forming means). The radius of said closing curve being at its smallest approximating the radius of supra-equidyne 58 leading edge, and at its longest less than horizontal. For purposes of simplicity and scale (but not by way of limitation) the uphill breadth of equilibrium zone 60 can generally be defined by a distance approximately equal to the length of the rider's flow skimming vehicle, i.e., approximately three to ten feet.

The preferred embodiment for the shape of supra-equidyne area 58 can be defined by a portion of changing curve, e.g, an ellipse; parabola; hyperbola; or spiral. If a changing curve, the configuration of supra-equidyne area 58 is initially arcs of a closing curve (i.e., the ascending water encounters a decreasing radius as it ascends the face of the flow forming means). The radius of said closing curve is at its longest always less than the radius of the longest arc of equilibrium zone 60, and, at its smallest of sufficient size that a rider could still fit inside a resulting "tunnel wave". On the opposite end of the spectrum, said arcs of a closing curve can transition, after a distance at least equal to ⅔'s the length of the riders flow skimming vehicle (approximately two to seven feet), to arcs of an opening curve (i.e., the ascending water encounters an increasing radius as it ascends the face of the flow forming means). The only limitation as to the overall breadth of supra-equidyne area 58 in the direction of flow 38 is the practical limitation of available head of an upwardly sheeting flow.

Super-critical water flow 39 originating from a water source (not shown) moves in direction 38 to produce a conforming flow over sub-equidyne area 62, equilibrium zone 60, and supra-equidyne area 58 to form an inclined body of water upon which a rider (not shown) can ride and perform surfing or water skimming maneuvers that would not be available but for such Connected Structure 57.

Operation of the Connected Structure

The significance of Connected Structure 57 is a function of how it can be used to enable the performance of surfing and water skimming maneuvers. Essential to the performance of modern surfing and skimming maneuvers are the elements of oscillation, speed, and proper area proportion in the "wave" surface that one rides upon. Each element is elaborated as follows:

OSCILLATION: The heart and soul of modern surfing is the opportunity for the rider to enjoy substantial oscillation between the supra-critical and sub-critical areas. As one gains expertise, the area of equilibrium is only perceived as a transition area that one necessarily passes through in route to supra and sub critical areas. Oscillatory motion has the added advantage of allowing a rider to increase his speed.

SPEED: Speed is an essential ingredient to accomplish modern surf maneuvers. Without sufficient speed, one cannot "launch" into a maneuver. The method and means for increasing one's speed on a properly shaped wave face can be made clear by analogy to the increase of speed on a playground swing as examined in SCIENTIFIC AMERICAN, Mar. 1989, p. 106–109. On a swing, if one is crouching at the highest point of a swing to the rear, ones energy can be characterized as entirely potential energy. As one descends, the energy is gradually transformed into kinetic energy and one gains speed. When one reaches the lowest point, one's energy is entirely kinetic energy and one is moving at peak speed. As one begins to ascend on the arc, the transformation is reversed: one slows down and then stops momentarily at the top of the arc. Whether one goes higher (and faster) during the course of a swing depends on what one has done during such swing. If one continues to crouch, the upward motion is a mirror image of the downward motion, and ones center of mass ends up just as high as when one began the forward swing. If instead one stands when one is at the lowest point, i.e., "pumping" the swing, then one would swing higher and faster.

The importance of sub-equidyne area 62 in the context of the previous discussion of swing dynamics, is that sub-equidyne area 62 is by its nature the lowest point on Connected Structure 57 and on a wave. Standing/extending at this low point results in a larger increase of speed than if one stood at any other point on Connected Surface 57 or on a wave. This increase in speed and total kinetic energy is due to two different mechanistic principals, both of which may be utilized by a rider on Connected Structure 57 or a wave. By standing at the lowest point in the oscillatory path, the center of gravity of the rider is raised allowing a greater vertical excursion up the slope than the original descent. Crouching at the top of the path and alternately standing at the bottom allows an increase in vertical excursion and restoration of energy lost to fluid drag. Additionally, the other mechanism, increasing the kinetic energy, is due to the increase in angular rotation. As the rider in his path rotates around a point located up the wave face, extension/standing at the low point increases his angular velocity much in the same manner as a skater by drawing in his/her arms increases his/her rotational speed due to the conservation of momentum. However, kinetic energy increases due to the work of standing against the centrifugal force and because kinetic energy is proportional to the square of angular velocity, this increase in kinetic energy is equivalent to an increase in speed.

PROPER AREA PROPORTION: Connected Structure 57 as a flow forming surface combines in proper proportion the sub-critical 62, equilibrium 60, and supra-critical 58 areas so as to enable a rider to oscillate, attain the requisite speed and have available the requisite transition area for performance of modern day surfing and skimming maneuvers that would not be possible, but for said Connected Structure 57.

Figure 10:
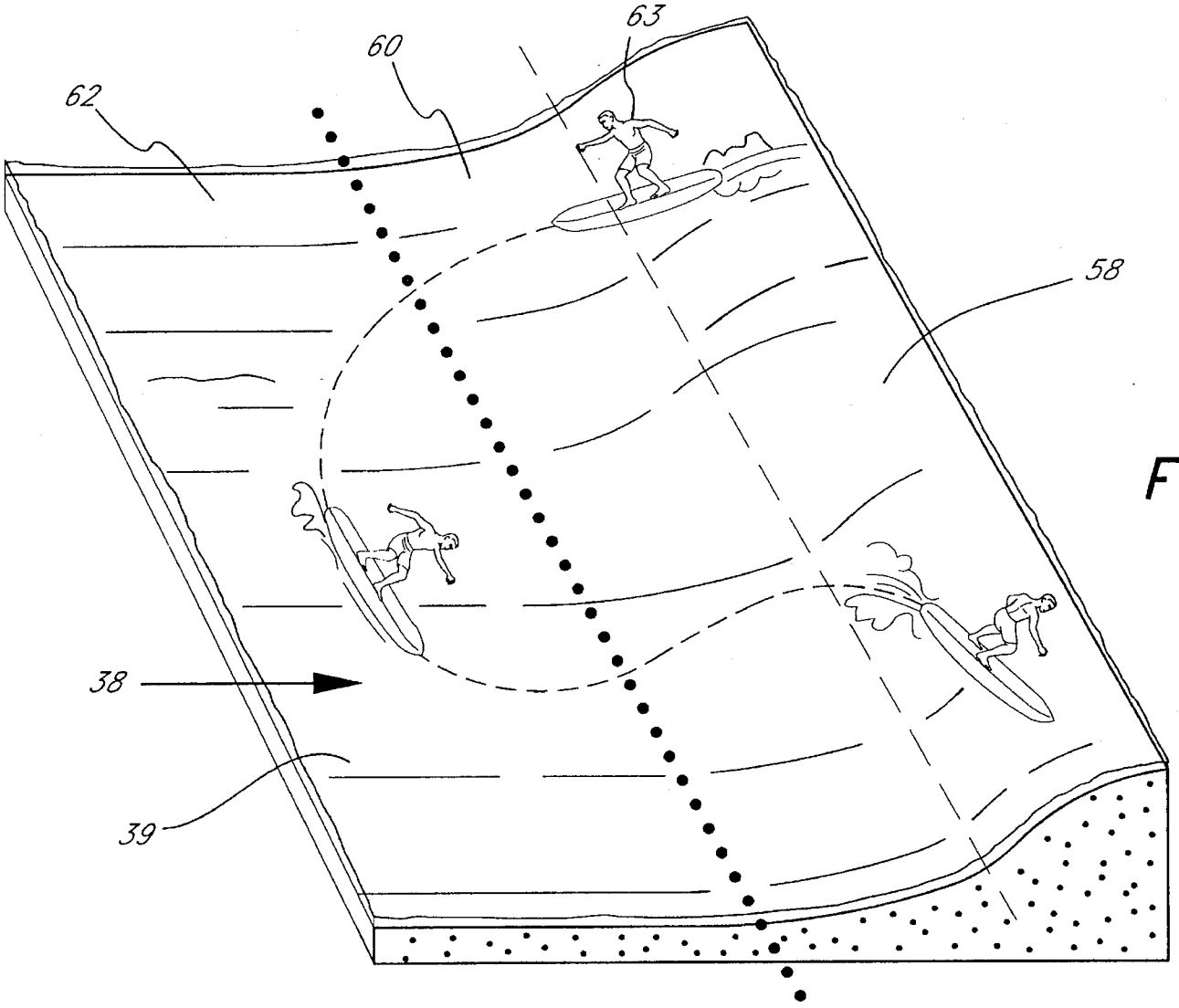
FIG. 10 depicts a surfer riding an Inclined Surface as improved by the Connected Structure and who is taking advantage of the acceleration process.

Turning to FIG. 10 there is illustrated a surfer 63 on an inclined surface as improved by Connected Structure 57 in various stages of a surfing maneuver. Surfer 63 is in a crouched position on supra-equidyne area 58 and gathering speed as he moves downward over a conformed sheet of super-critical water flow 39 which originates from a water source (not shown) and moves in direction 38. Upon reaching the low point at sub-equidyne area 62, surfer 63 extends his body and simultaneously carves a turn to return to supra-equidyne area 58. As a consequence of such maneuvering, surfer 63 will witness an increase in speed to assist in the performance of additional surfing maneuvers. The process by which a surfing or water skimming rider can actively maneuver to increase his speed is referred to as the Acceleration Process.

Description of Self-Clearing Incline and Tunnel Wave

Figure 11A:
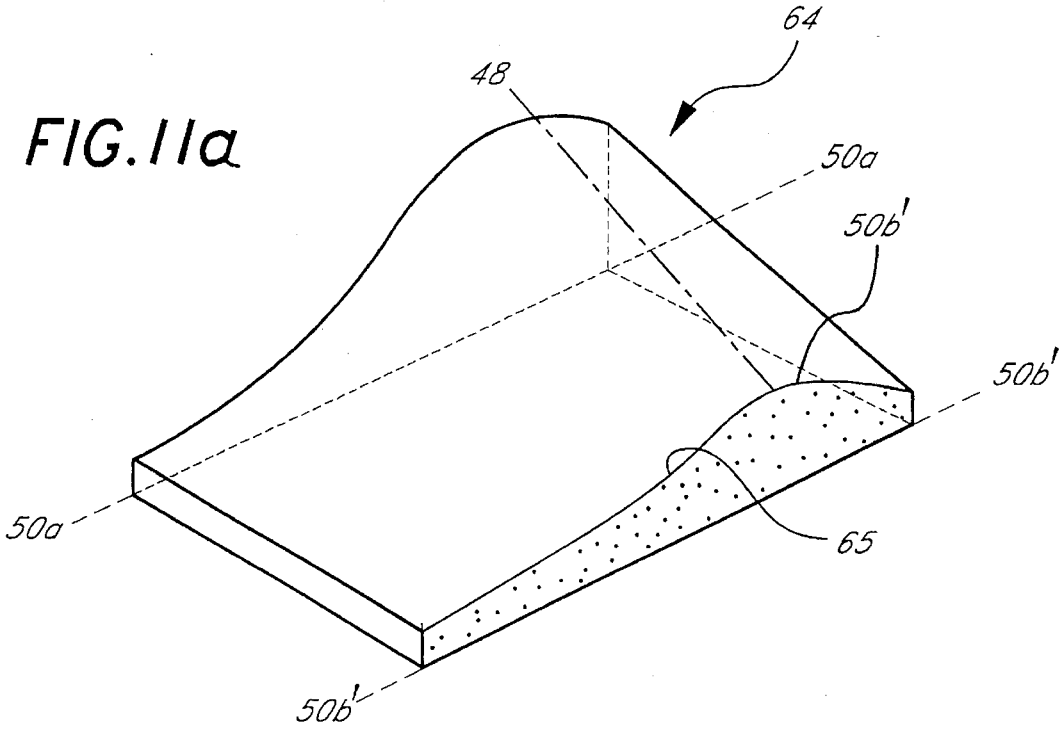
FIG. 11*a* is a profile view of the Self Clearing Incline.
Figure 11B:
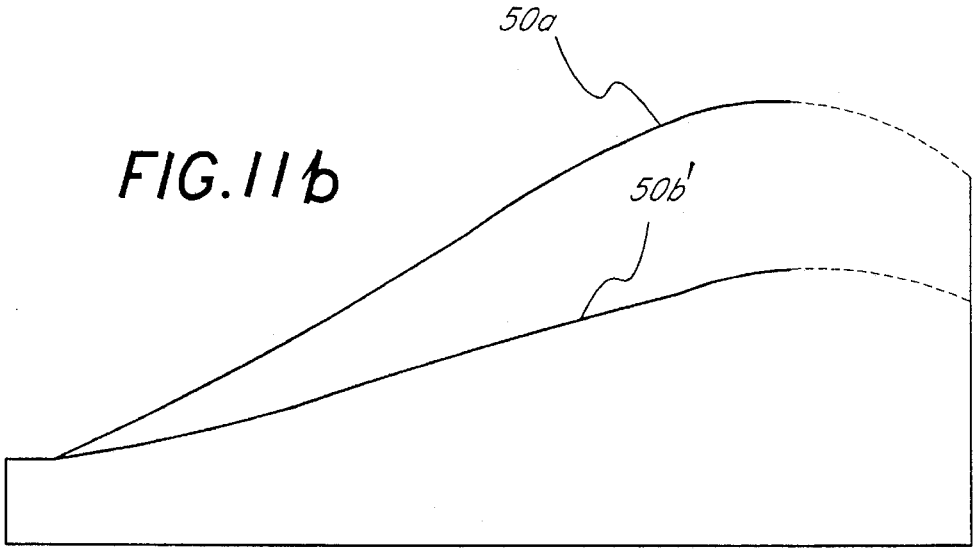
FIG. 11*b* is a cross-section of FIG. 11*a*.

Turning to FIG. 11*a* (isometric view) and FIG. 11*b* (cross-sectional view) there is illustrated a top vent self-clearing incline improvement for Shallow Flow Inclined Surface (as improved by Connected Structure) all of which is hereafter referred to as a Self-Clearing Incline 64. Self- Clearing Incline 64 is comprised of Shallow Flow Inclined Surface as modified by lowering the elevation of side edge 50*b*' and causing downstream ridge line 48 to incline from the horizontal. FIG. 11*b* superimposes a cross-sectional profile of side edge 50*a* over the lowered side edge 50*b*'. To have a noticeable effect, the angle of inclination should be a minimum 5 degrees.

Turning to FIG. 12 (contour map) there is illustrated a swale self-clearing incline improvement for Tunnel "Wave" Generator 30 (as improved by Connected Structure 57) all of which is hereafter referred to as Self-Clearing Tunnel Wave 66, comprised of sculpting from front surface 32, sub-equidyne area 62 and structural matrix support 37 (not shown) a shallow venting swale 65. All surfaces of swale 65 are smooth and without edges.

Operation of Self-Clearing Incline and Tunnel Wave

Self-Clearing Incline 64 and Self-Clearing Tunnel Wave 66 are designed to prevent unwanted turbulent white water build-up that fails to clear from the riding surface in the usual manner of "washing" over the downstream ridge of these respective embodiments. In practice, this vent problem will only occur if there is a restriction on flow venting to the side of the inclined surface or generator, e.g., a channel wall, or where there is a tremendous amount of activity, e.g., multiple riders on the surface of the water.

This undesirable build-up is particularly acute in an upward directed flow. This build-up will most likely occur during three stages of operation, (1) water flow start-up with no rider present; (2) transferring the kinetic energy of high speed water flow to a maneuvering rider; and (3) cumulative build-up of water due to a spilling wave. In the start-up situation (1), due to the gradual build up of water flow associated with pump/motor phase in or valve opening, the initial rush is often of less volume, velocity or pressure than that which issues later. Consequently, this initial start water is pushed by the stronger flow, higher pressure, or faster water that issues thereafter. Such pushing results in a build-up of water (a hydraulic jump or transient surge) at the leading edge of the flow. An upward incline of the riding surface serves only to compound the problem, since the greater the transient surge, the greater the energy that is required to continue pushing such surge in an upward fashion. Consequently, the transient surge will continue to build and if unrelieved will result in overall flow velocity decay, i.e., the slowed water causes additional water to pile up and ultimately collapse back onto itself into a turbulent mass of bubbling white water that marks the termination of the predominantly unidirectional super-critical sheet flow. In the situation of kinetic energy transfer (2), when a maneuvering rider encounters faster flowing water or water that is moving in a direction different than the rider, a transient surge builds behind or around the rider. Likewise, if this transient surge grows too large it will choke the flow of higher speed unidirectional super-critical sheet flow, thus, causing flow decay. In the situation of an excessive build up of water over time from a spilling wave (3), the interference of a preceding flow with a subsequent flow can result in an undesired transient surge and flow decay at a point near where the two flows meet. Under all three conditions, it is possible to control or eliminate the transient surge by immediately increasing the flow pressure and over-powering or washing the transient surge off the riding surface. However, there comes a point where the build-up of water volume is so great that for all practical purposes over-powering is either impossible, or at best, a costly solution to a problem capable of less expensive solution. Such less expensive solution is possible by the introduction of vents.

Figure 13A:
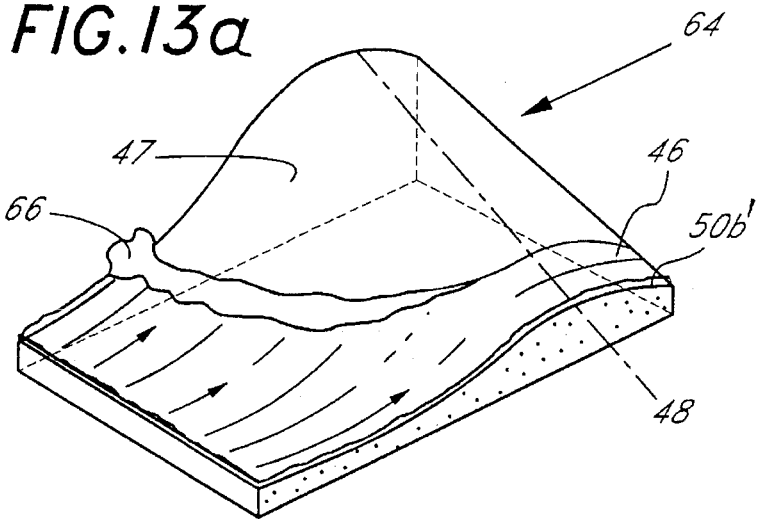
FIG. 13*a*, FIG. 13*b*, and FIG. 13*c* are three views in profile that illustrate in time lapse sequence a self-clearing Inclined Surface.
Figure 13B:
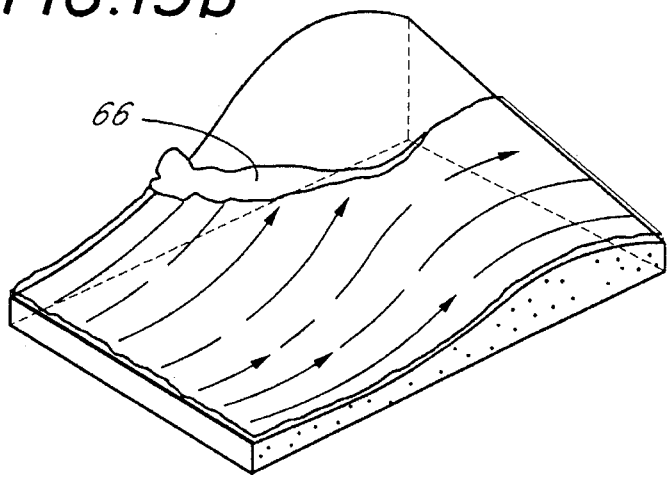
Figure 13C:
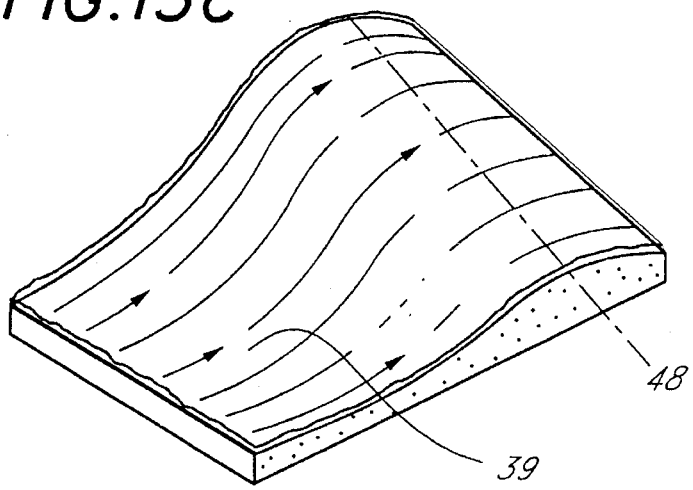

Two classes of vent mechanisms are identifiable. The first class, self-clearing inclines, are used to clear transient surges from inclined surfaces. FIG. 13*a*, 13*b*, and 13*c* show in time lapse sequence how the design of self-clearing incline 64 operates to solve the problem of a pressure/flow lag during start-up. In FIG. 13*a* water flow 39 has commenced issue in an uphill direction from water source (not shown) in direction 38. As water flow 39 moves up front surface 47, the leading edge of water flow is slowed down by a combination of the downward force of gravity and friction with front surface 47, whereupon, it is overtaken and pushed by the faster and stronger flow of water that subsequently issued from the water source. The result of this flow dynamic is that a transient surge 68 begins to build. However, as transient surge 68 builds, it reaches the height of low side edge 50*b*' and commences to spill over onto back surface 46. FIG. 13*b* shows this start procedure moments later wherein the water pressure/flow rate from the water source has increased and transient surge 68 has moved further up the incline. FIG. 13*c* shows the final stage of start-up wherein the transient surge has been pushed over the top of Down Stream Ridge Line 48 and water flow 39 now runs clear. Similar to the start-up procedure, when a lower speed rider encounters the higher speed water, or when an accumulative build-up of water results from a spilling wave, a transient surge may occur. In like manner, the transient surge will clear by spilling off to the lowered side accordingly.

The second class of vent mechanism, swale vents, are used to assist in clearing transient surges from tunnel wave generators. FIG. 14*a* and 14*b* show in time lapse sequence how the design of swale 67 operates to solve identical problems as suffered by the inclined surfaces with channel walls. In FIG. 14*a* water flow 39 has commenced issue in an uphill direction from water source (not shown) in direction 38. Transient surge 68 begins to build. However, as transient surge 68 builds, it commences to vent into swale 67, thus, permitting tunnel wave 42 to properly form as shown in FIG. 14*b*.

Description and Operation of the Omni-Wave

Figure 15:
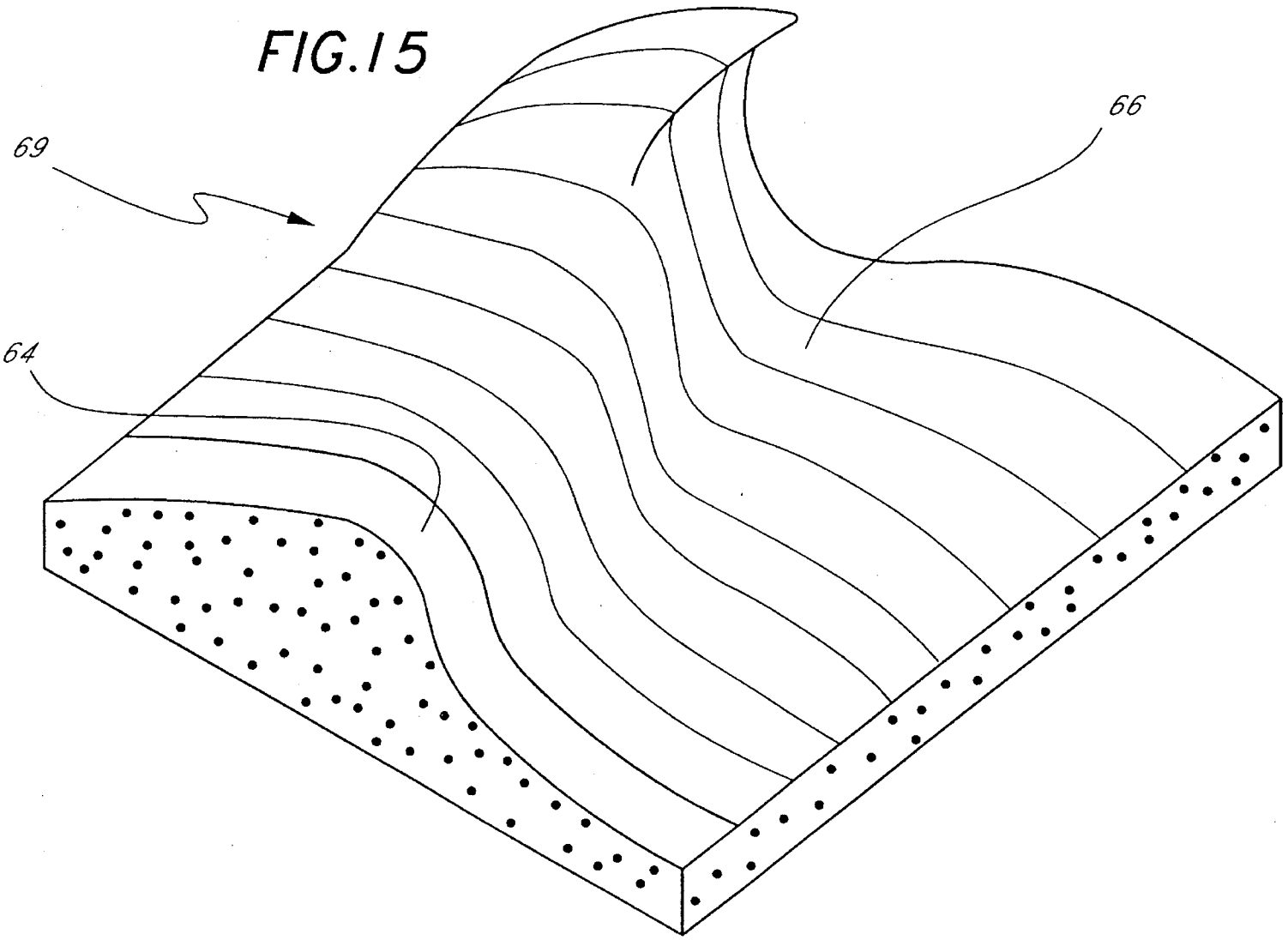
FIG. 15 is a profile view of the Omni-Wave.

FIG. 15 depicts a preferred embodiment herein named an Omni-wave 69 comprised of Self-Clearing Incline 64 which is interconnected and continuous with Self-Clearing Tunnel Wave 66.

Figure 16A:
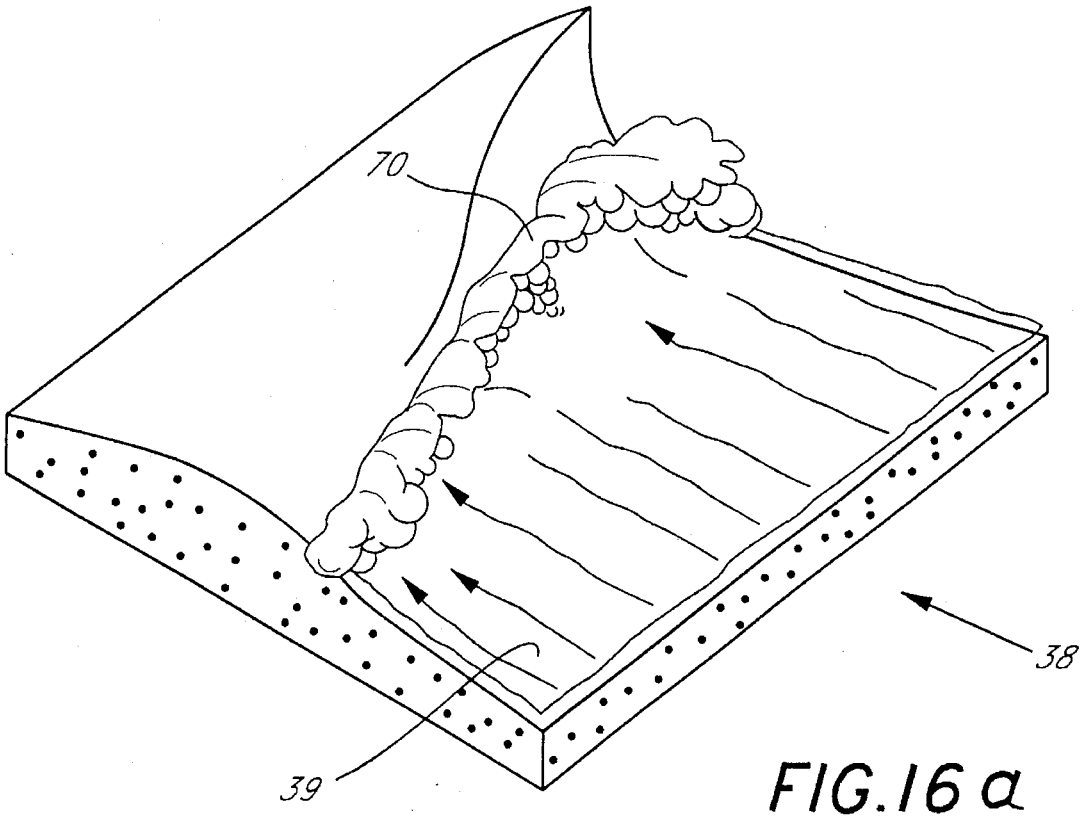
FIG. 16*a* depicts the Omni-Wave with a spilling wave formed along its entire front face.
Figure 16B:
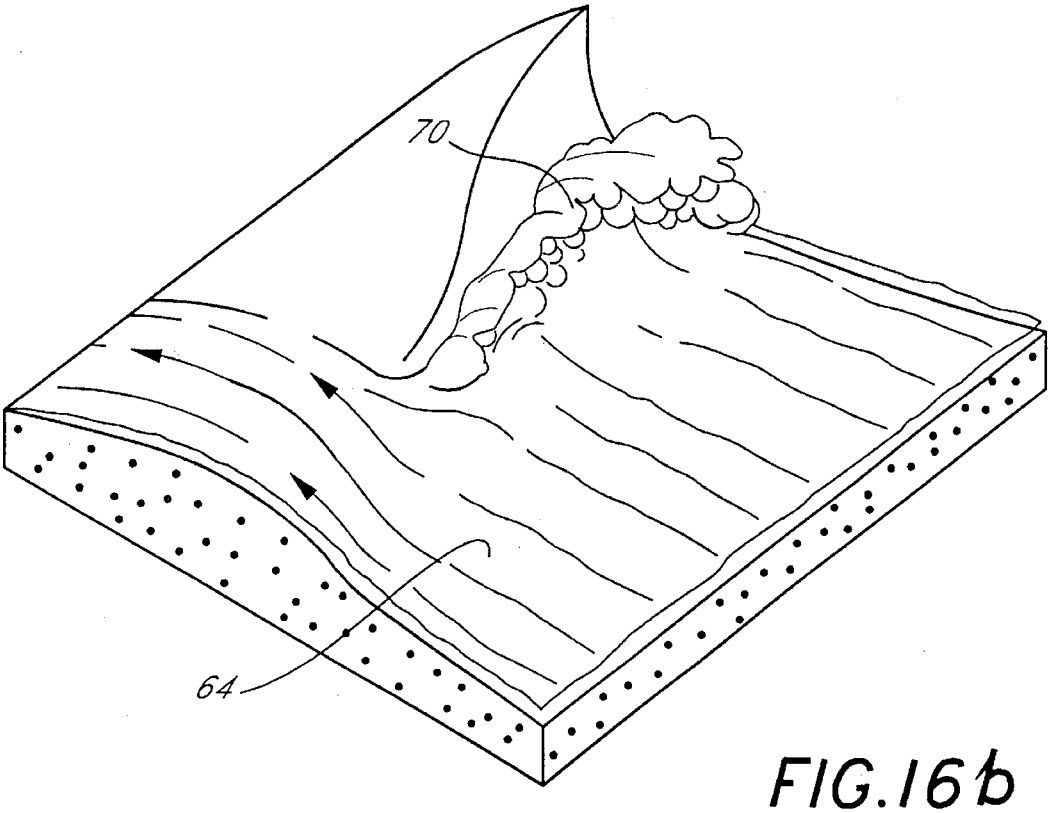
FIG. 16*b* depicts the Omni-Wave with a clear inclined surface and a spilling wave.
Figure 16C:
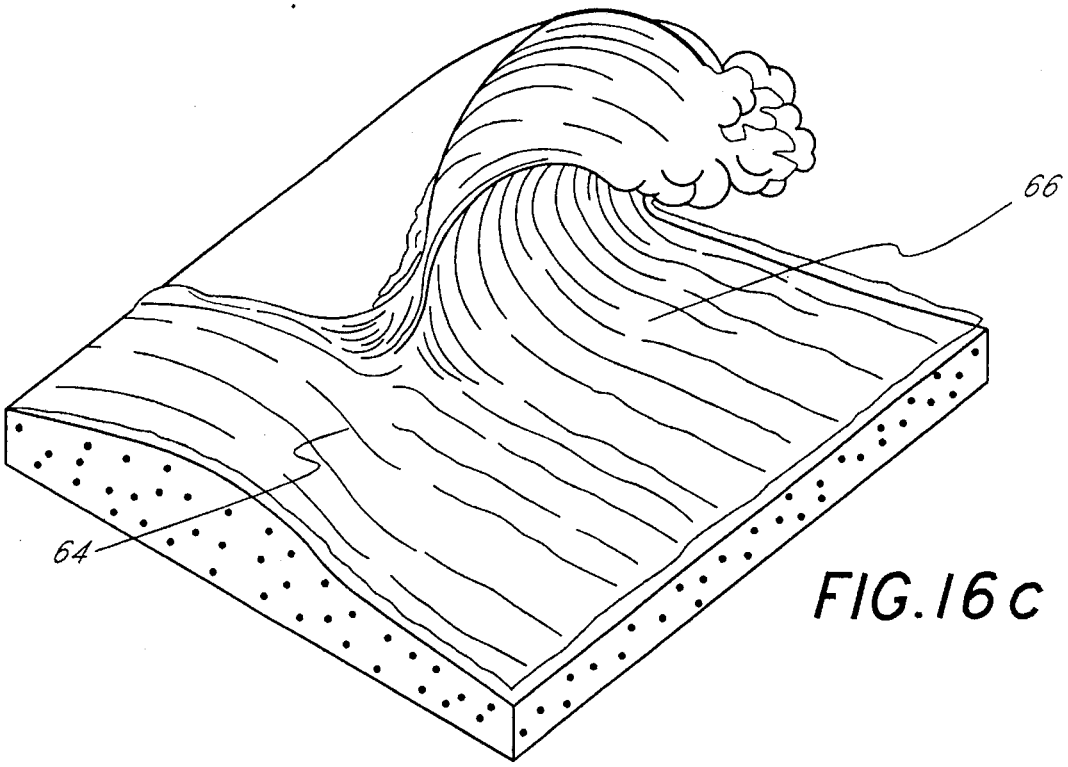
FIG. 16*c* depicts the Omni-Wave with a clear inclined surface and a Tunnel Wave.
Figure 16D:
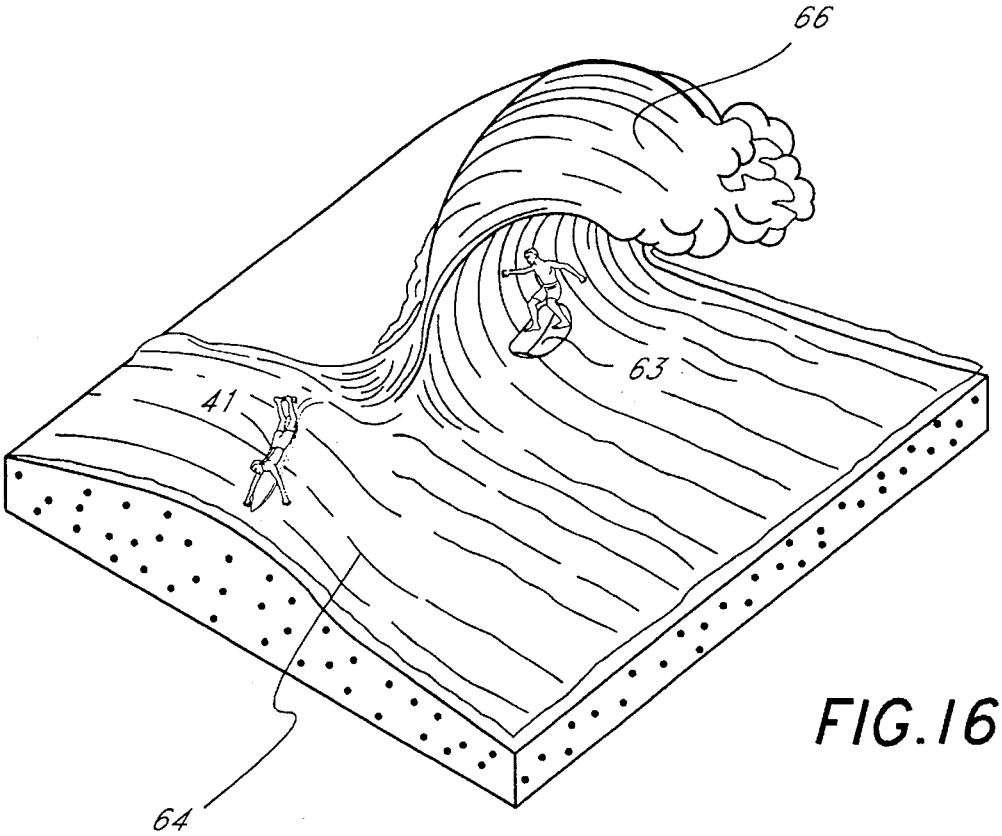
FIG. 16*d* depicts a Body Boarder performing water skimming maneuvers and a surfer performing surfing maneuvers on the Omni-Wave.
Figure 16E:
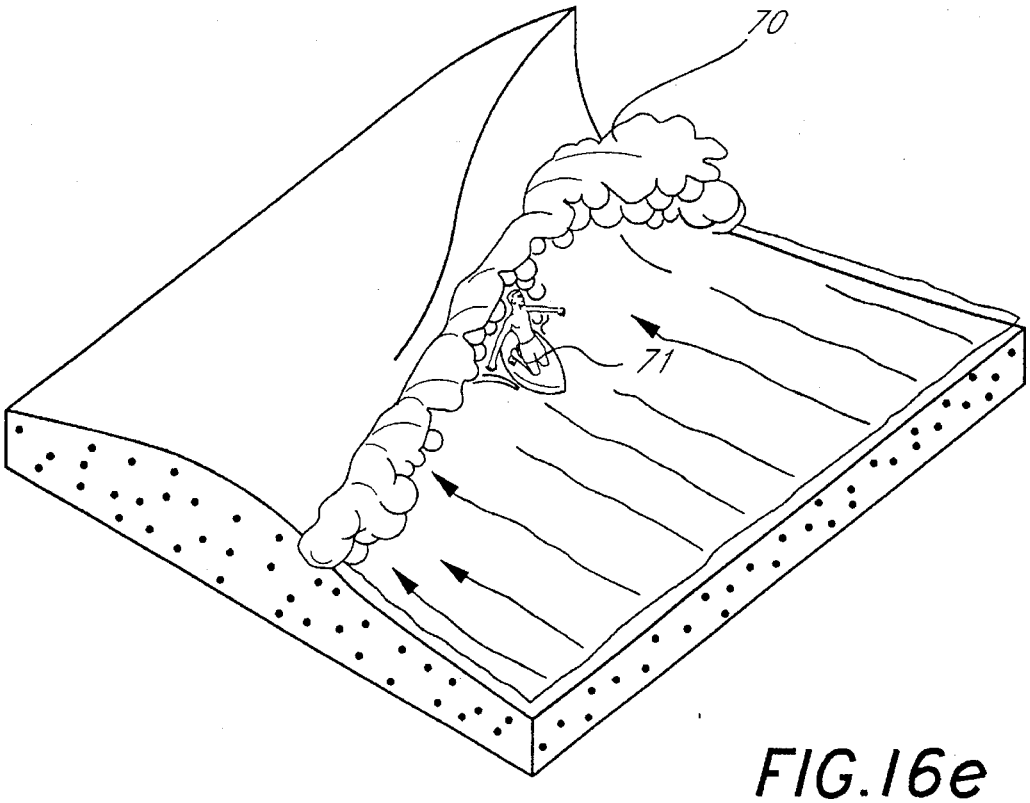
FIG. 16*e* depicts a knee boarder riding the spilling wave.
Figure 16F:
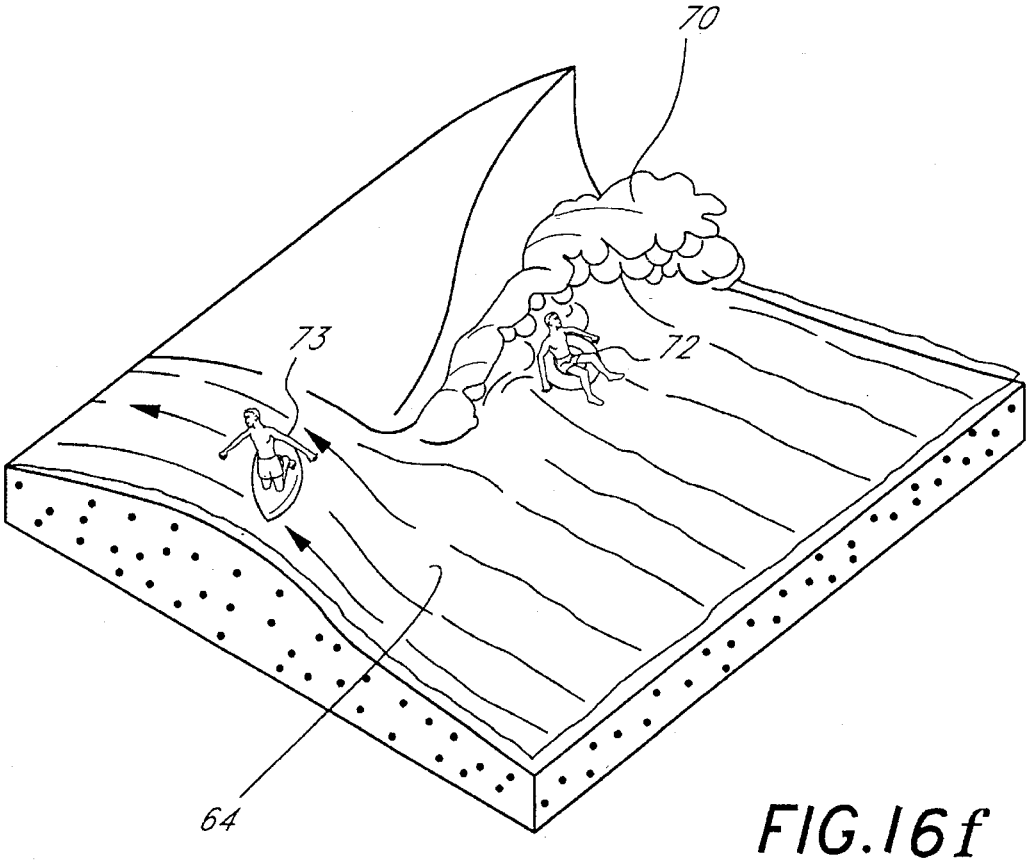
FIG. 16*f* depicts a water skier on the inclined surface and an inner-tube rider on the spilling wave.

FIG. 16*a*, FIG. 16*b*, FIG. 16*c*, FIG. 16*d*, FIG. 16*e* and FIG. 16*f* illustrates Omni-Wave 69 in operation. A unique feature of Omni-Wave 69 is its unique flow forming shape can permit (by way of a progressive increase of the net head of the water flow) the transformation of super-critical water flow 39 that originates from a water source (not shown) in direction 38 to a stationary spilling wave 70 along the entire forming means (as illustrated in FIG. 16*a*); to a stationary spilling wave 70 with Self Clearing Incline 64 flow (as illustrated in FIG. 16*b*); to a Self-Clearing Incline 64 and Self-Clearing Tunnel Wave 66 flow (as illustrated in FIG. 16*c*). This progressive wave forming method is hereinafter referred to as the "Wave Transformation Process". The Omni-Wave and the Wave Transformation Process will offer an improved environment for the performance of surfing and water skimming maneuvers. FIG. 16*d* shows surfer 63 and rider 41 on Self-Clearing Tunnel Wave 66 and Self-Clearing Incline 64 respectively. FIG. 16*e* shows surfer water skimming kneeboarder riding upon stationary spilling wave 70, FIG. 16*f* shows inner-tube rider 72 and water skier 73 on stationary spilling wave 70 and Self-Clearing Incline 64 respectively.

Description and Operation of the Fluid Half Pipe

Figure 17:
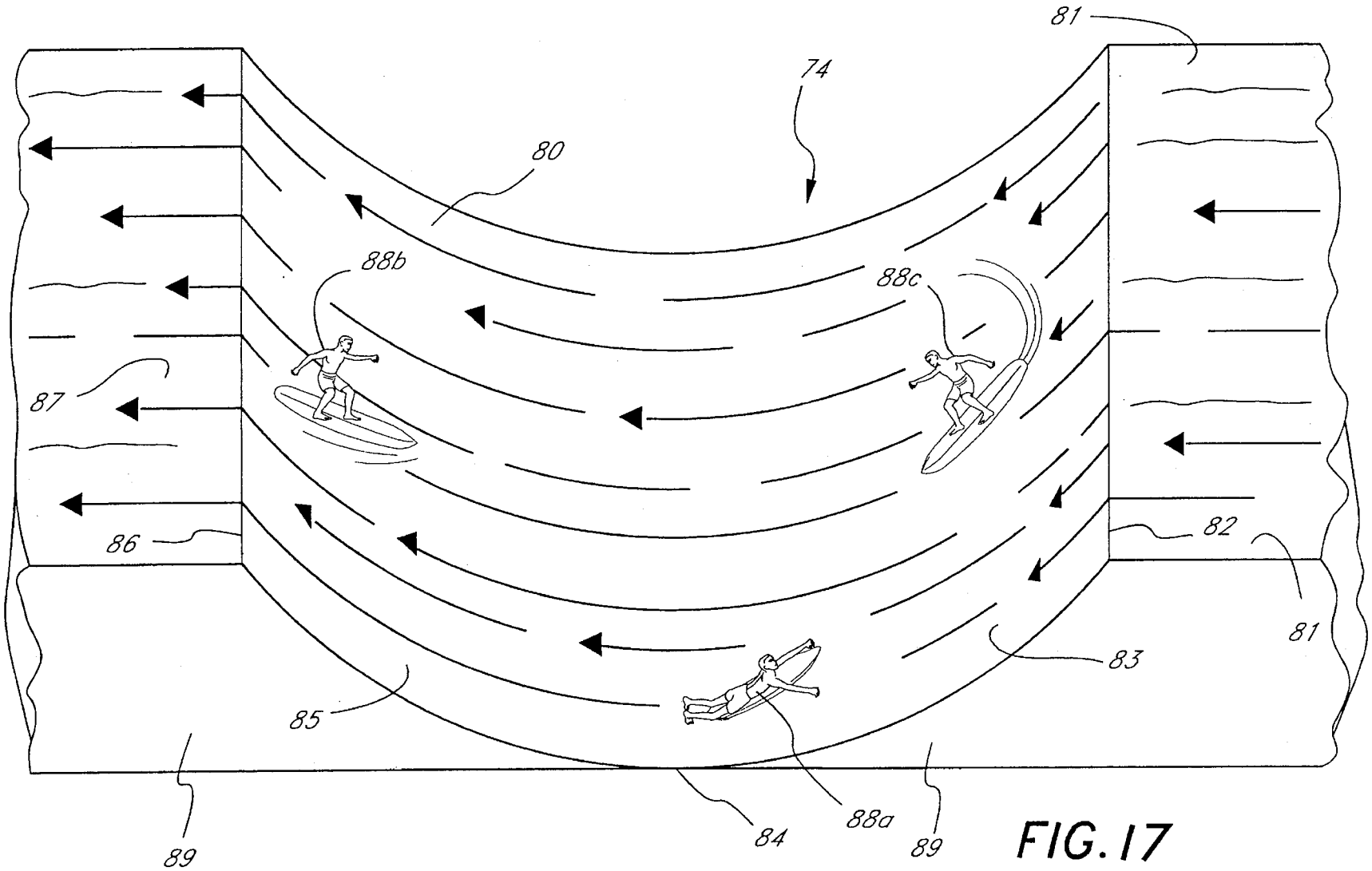
FIG. 17 shows in profile view of a novel embodiment for water sports—the Fluid Half-Pipe.

Turning to FIG. 17 wherein an apparatus is revealed that will enable riders to perform surfing and water skimming maneuvers in a format heretofore unavailable except by analogy to participants in the separate and distinct sports of skateboarding and snowboarding, to wit, half-pipe riding. Fluid Half-Pipe 74, comprises a method and apparatus for generating a body of water 80 with a stable shape and an inclined surface thereon substantially in the configuration of a half-pipe with the opening of said half-pipe facing in an upwards direction. The water 81 which supplies said body of water flows over the leading edge 82 of the half-pipe flow forming means 89 and down one side (hereinafter referred to as the down-flow-side 83), in a direction perpendicular to the length of said half-pipe, across an appropriate sub-equidyne flat section 84, and up and over the other side of the half-pipe (hereinafter referred to as the up-flow-side 85), across the trailing edge 86, and into an appropriate receiving pool 87 or other suitably positioned Fluid Half Pipe or attraction. A rider 88*a* enters the flow at any appropriate point, e.g., sub-equidyne flat section 84, wherein as a result of his initial forward momentum of entry, the excessive drag of his water-skimming vehicle, and the added drag of the riders weight induced trim adjustments to his riding vehicle, said rider (now 88*b*) is upwardly carried to a supra-critical area in the upper regions of up-flow-side 85 near the half pipe's trailing edge 86, wherein as a result of the force of gravity in excess of the drag force associated with the riding vehicle and the riders own weight trim adjustments to reduce drag, rider (now 88*c*) hydro-planes down the up-flow-side 85, across the sub-equidyne flat 84, and performs a turn on down flow side 83 to return to up-flow-side 85 and repeat cycle.

As can be appreciated by those skilled in the art, Fluid Half-Pipe 74 will offer its participants a consistent environment in which to perform known surfing and water skimming maneuvers, and due to the combination of up-side-flow, flat, and down-side-flow a unique environment in which to perform new maneuvers unachievable on existing wave surfaces.

The preferred embodiment for the breadth of the flow forming means 89 of Fluid Half-Pipe 74 approximates Connected Structure 57 joined to its mirror image at the midpoint of sub-equidyne 62. It is preferred that said width remain constant for the length of flow-forming means 89, however, variations in width with resultant variations in cross-sectional shape are possible. The limitations on minimum and maximum width is a function of ones ability to perform surfing and water skimming maneuvers. If the flow forming means is too narrow, a rider would be unable to negotiate the transition from the up-flow side 85 to the down-flow-side 83 or vice versa. If too wide, a rider would not be able to reach or utilize the down-flow side 83 to perform surfing and water skimming maneuvers.

A preferred embodiment for the length of the flow forming means of Fluid Half-Pipe 74 is at a minimum a length sufficiently wide to perform surfing and water skimming maneuvers thereon, and at a maximum a function of desire and/or budget.

Figure 9B:
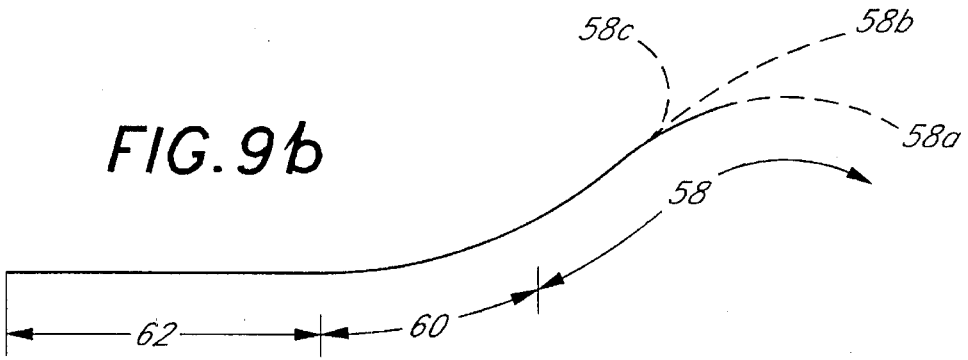
FIG. 9*b* is a cross-section of FIG. 9*a*.

A preferred embodiment for the cross-sectional shape of the up-flow side's flow forming means has been shown in FIG. 9*b* and discussed above. FIG. 9*b* illustrated a detailed cross-section of Connected Structure 57, with sub-equidyne area 62, equilibrium zone 60, and supra-equidyne area 58. Caution must be taken in the design of the up-flow-side 85 supra-equidyne area to insure proper water flow up and over the trailing edge 86. Excessive steepness or height that results in untimely or improperly located spilling or tunneling waves can result in an excessive build-up of turbulent white water in the sub-equidyne flat area 84 which may culminate in complete deterioration of the up-side-flow. However, since advanced riders, in order to maximize speed and perform certain maneuvers, e.g., aerials, prefer a steep supra-critical area that approaches or exceeds vertical then it is preferred that spilling or tunnel wave formation (if any) be limited to areas adjacent the side openings of half-pipe 74, and that the majority middle half pipe 74 be substantially the shape as illustrated in FIG. 9*b* with supra-equidyne configuration 58*a*.

Generally, the elevation of half-pipe 74 leading edge 82 will exceed its line-of-flow position on half-pipe 74 trailing edge 86. This differential in elevation will insure that the water of said body of water 81 will have sufficient dynamic head to overcome all internal and external friction that may be encountered in its circuit down, across, up, and over flow forming means 89. The preferred ratio by which the down-flow-side exceeds the up-flow-side ranges from a minimum of ten to nine to a maximum of ten to one. It is also preferred that the respective leading and trailing edge 82 and 86 remain at constant elevations along the length of the half-pipe. Variations in elevation are possible, however, source pool water 81 dynamics, receiving pool water 87 dynamics, and maintenance of line of flow dynamic head must be accounted for.

Figure 18A:
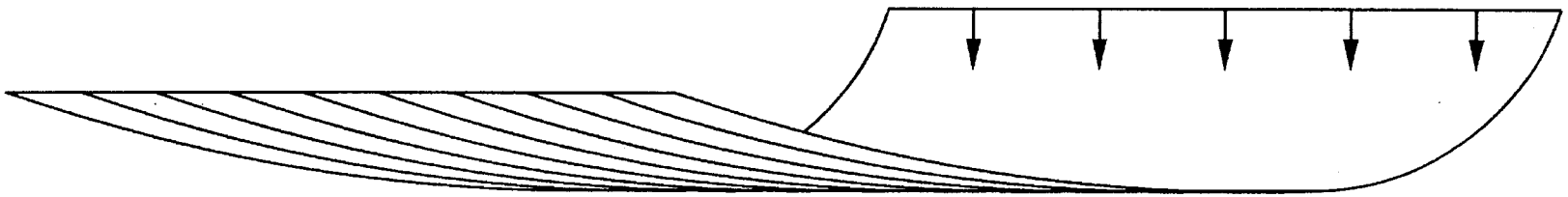
FIG. 18*a* shows an elevation of a typical Fluid Half-Pipe.
Figure 18B:
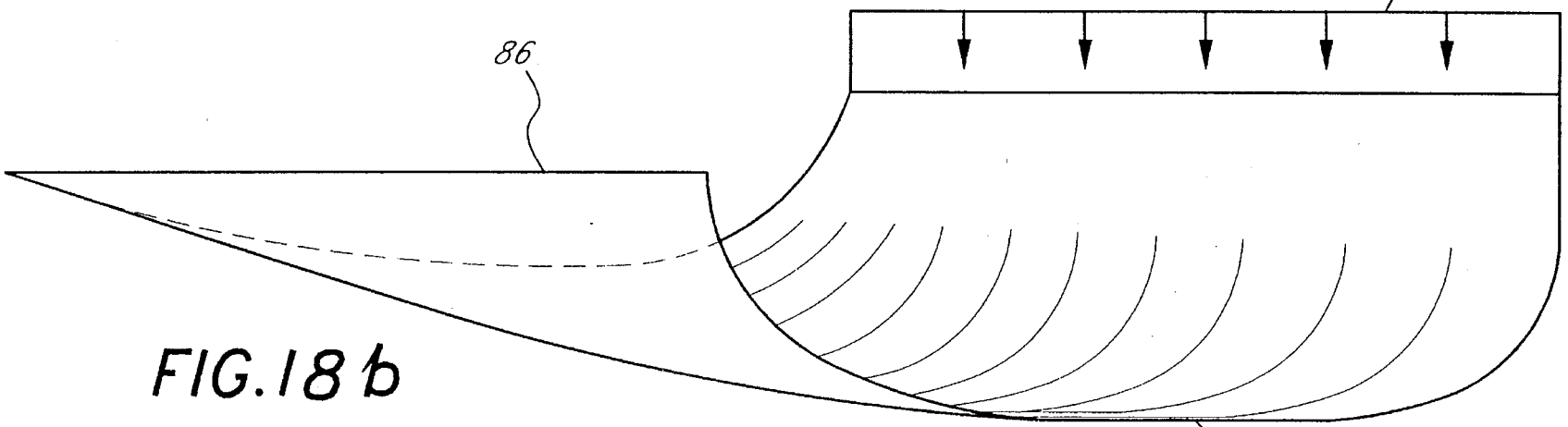
FIG. 18*b* shows an elevation of a Fluid Half-Pipe with modified flow forming bottom to assist in capacity and rider through put.

In cross-sectional profile, a standard configuration for Fluid Half Pipe 74 is illustrated in FIG. 18*a*. In this standard configuration the cross-sectional elevation, width, and depth remains constant for the length of half-pipe 74. FIG. 18*b* illustrates an asymmetrical configuration, wherein, the leading and trailing edges 82 and 86 remain at constant elevations and the width between trailing edges remains constant, however, the distance between trailing edges and the flat sub-equidyne section 84 continues to increase at a constant rate of fall. The object of this particular asymmetrical embodiment is to increase throughput capacity for half-pipe 74 as the result of rider movement in the direction of fall due to the added vector component of gravity force ascribed to the weight of the rider in the direction of fall.

The preferred velocity of water in the subject invention is substantially a function of the overall drop in distance from leading edge 82 to the flat area 84. Consequently, previously discussed preferences in the overall height of the Connected Structure dictate the preferred water velocity. Such velocity can be calculated in accordance with Bernoulli's equation $v=\sqrt{2}\ gz$ where v is the velocity in feet per second, g is gravity ft/sec$^2$ and z=vertical distance dropped in feet.

The preferred depth of water is that which is required to perform surfing and water skimming maneuvers. For purposes of Half Pipe 74 the minimum depth is 2 cm. and the maximum depth is whatever one might be able to afford to pump. Except the desirable spilling/tunnel wave formation adjacent a side-opening of half-pipe 74, an additional preference is that the water avoid excessive turbulence that results from a hydraulic jump which occurs when the velocity of a sheeting body of water exceeds a certain critical velocity at a certain minimum depth.

Figure 19:
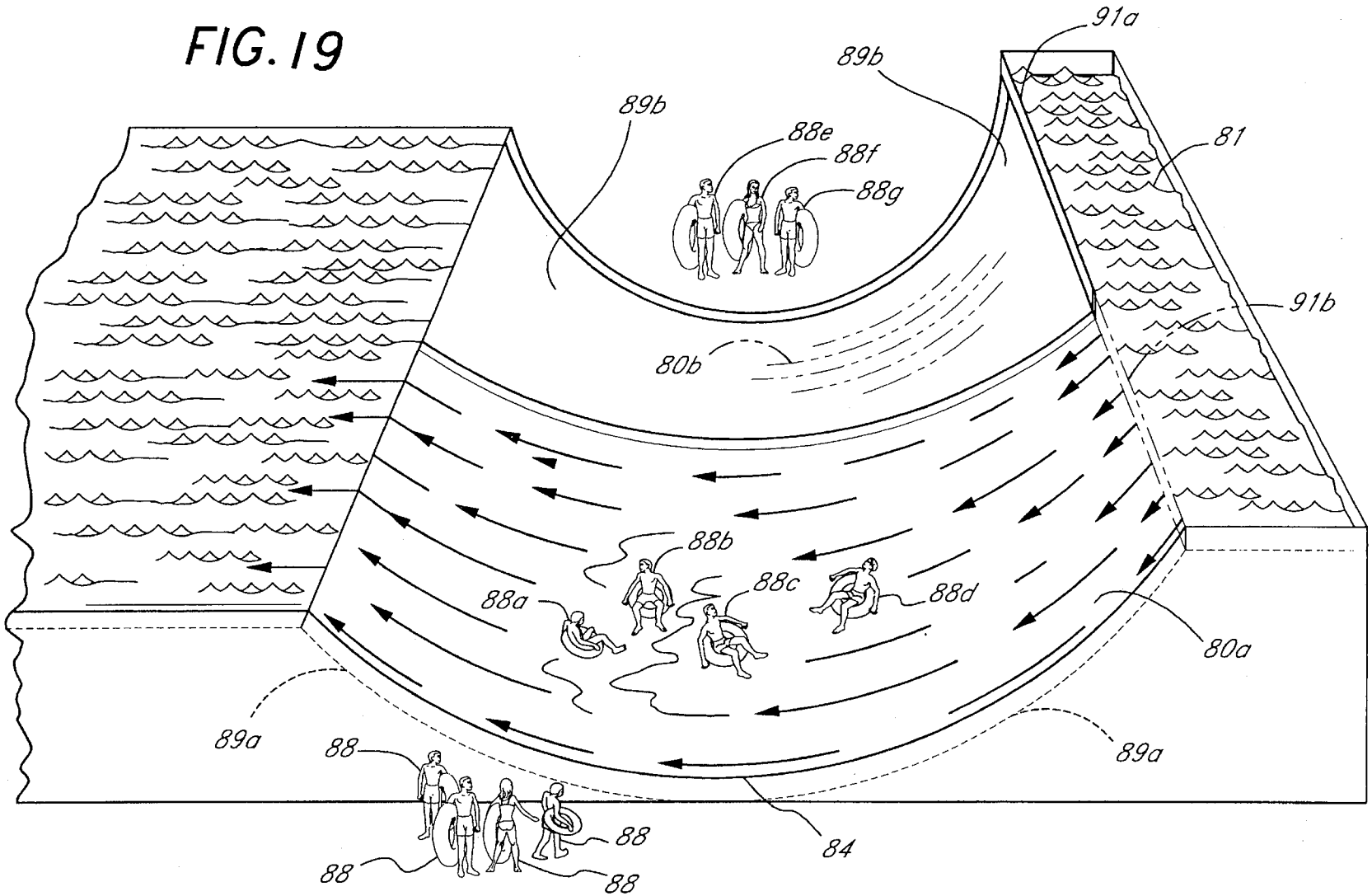
FIG. 19 illustrates in profile view an improvement to the Fluid Half-Pipe to assist in increased through put capacity.

Variations in the breadth and longitudinal movement of the body of water that flows upon the half-pipe can result in enhancements to rider through-put capacity for the Fluid-Half Pipe. FIG. 19 depicts a half-pipe configured flow forming means 89. A stably shaped body of water 80*a* is situated on one side 89*a* of said flow forming means. The water 81 which supplies said stably shaped body of water is limited by a dam 91*a* to just one-half of the flow forming means 89. Riders 88*a, b, c and d* enter the flow at any appropriate point., e.g., the sub-equidyne flat section 84 and perform water skimming maneuvers thereon. As shown in FIG. 19, the water skimming maneuvers are performed using an inner-tube type vehicle. After an elapsed period of time, e.g., several minutes, a dam 91*b* is positioned to block the water 81 which supplies the stably shaped body of water 80*a* on side 89*a* of said flow forming means. Upon blockage of the source of water, the stably shaped body of water 80*a* soon ceases to exist on side 89*a* of said flow forming means. Consequently, the riders 88*a, b, c* and *d* drift to the sub-equidyne section 84 and can easily exit. Simultaneously with, or shortly after the blockage by dam 91*b*, dam 91*a* opens and water 81 begins to flow over flow forming means 89*b*, whereupon forming a stably shaped body of water 80*b* that remains situated on side 89*b*. Riders 88*e, f,* and *g* enter the flow and commence to perform water skimming maneuvers for their allotted time span, whereupon dam 91*a* is re-positioned and the cycle is set to repeat.

Figure 20:
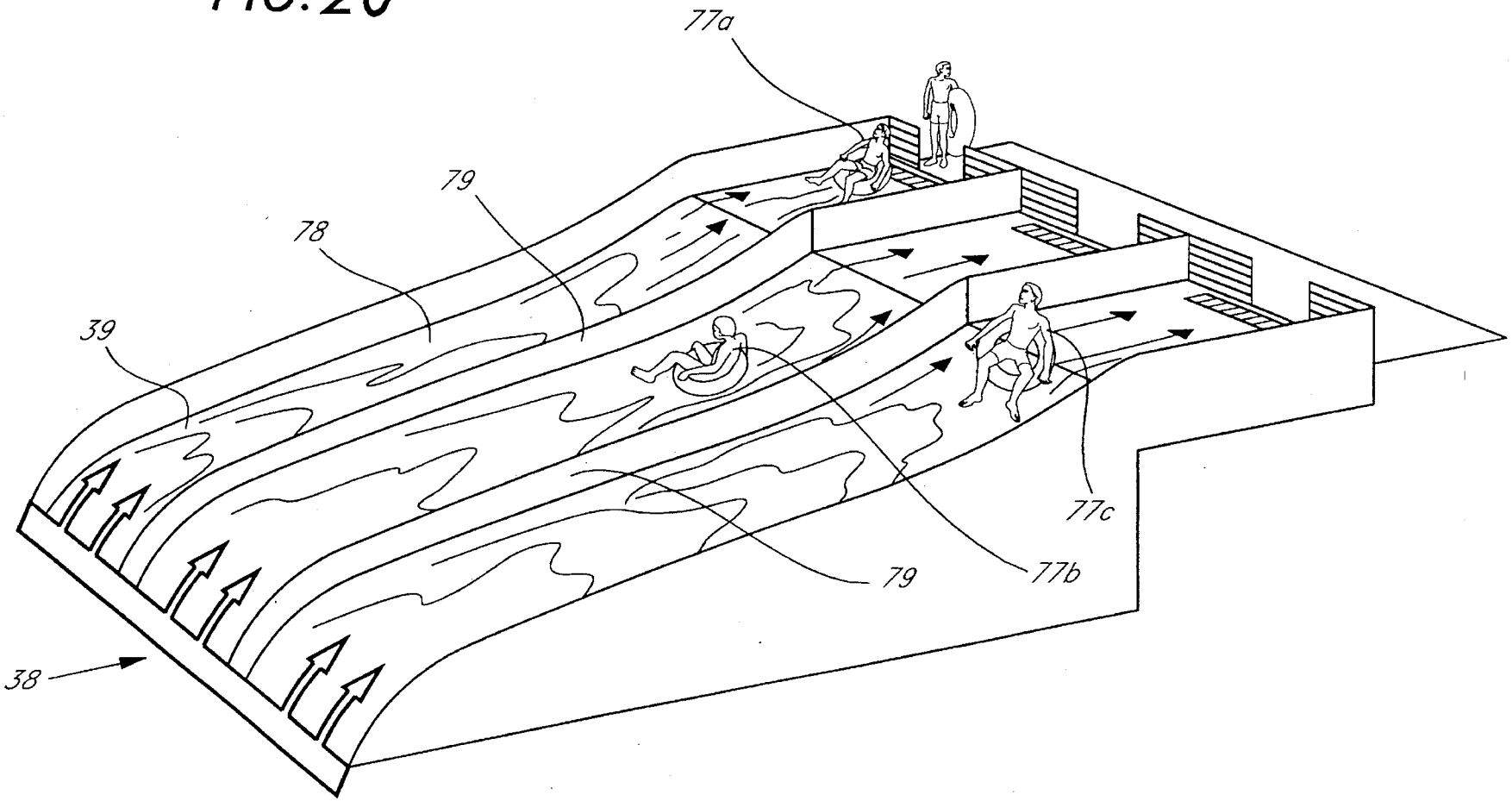
FIG. 20 shows dividers in a shallow flow to avoid flow "jet wash."

FIG. 20 illustrates super-critical water flow 39 originating from a water source (not shown) moving in direction 36 to produce a conforming upward flow over front face 78. Dividers 79 provide separation for the individual riders 77*a*, 77*b*, and 77*c* and to prevent a "jet wash" phenomenon that can result in loss of a rider's flow. This "jet wash" phenomenon occurs when a rider who is positioned in the equilibrium or supra-equidyne area of a thin sheet flow gets his flow of water cut off by a second rider positioned with priority to the line of flow. The cutting off of water occurs in thin sheet flow situations due to the squeegee effect caused by the second rider's skimming vehicle.

As will be recognized by those skilled in the art, certain modifications and changes can be made without departing from the spirit or intent of the present invention. For example, the curvatures given as examples for the Connected Structure do not have to be geometrically precise; approximations are sufficient. The same is true of limits in angles, radii and ratios. The temperature and density of the water will have some difference although the range of temperatures in which surfer/riders would be comfortable is fairly limited.

The terms and expressions which have been employed in the foregoing specifications are used therein as terms of description and not of limitation, and there is no intention, in the use of such terms and expressions, of excluding equivalents of the features shown and described, or portions thereof, it being recognized that the scope of the invention is defined and limited only by the claims which follow.

I claim:

1. A water ride apparatus for supporting a shallow flow of water thereon upon which water skimming maneuvers may be performed, said ride apparatus comprising a ride surface having:

a downward curving flow-supporting surface defining a leading edge of said ride surface relative to said shallow flow of water thereon;

an upward curving flow-supporting surface defining a trailing edge of said ride surface relative to said shallow flow of water thereon; and an intermediate flow-supporting surface contiguous with and curving substantially continuously downward and forward from said downward curving surface and then curving substantially upward and forward toward said upward curving surface;

said ride surface being disposed relative to said shallow flow of water such that said shallow flow of water flows from said leading edge of said ride surface to said trailing edge of said ride surface so as to form a concave riding surface upon which skateboard-like water skimming maneuvers may be performed.

2. The water ride apparatus of claim 1 wherein said ride surface is formed in the shape of a semi-circular tube having concave cylindrical flow-supporting surfaces of substantially uniform curvature.

3. The water ride apparatus of claim 1 wherein said ride surface is formed in the shape of a flattened cylinder wherein said intermediate surface is substantially elongated and less arcuate than said upward and downward curving surfaces,

4. The water ride apparatus of claim 1 wherein said ride surface is formed in an asymmetric configuration wherein the distance between said upward and downward curving surfaces and said intermediate surface varies in a direction transverse to said shallow flow of water.

5. The water ride apparatus of claim 1 wherein said leading edge of said ride surface is at a higher elevation than said trailing edge of said ride surface.

6. The water ride apparatus of claim 1 further comprising one or more dividers disposed tangentially to said shallow flow of water defining a plurality of riding lanes for accommodating multiple ride participants and/or ride vehicles while substantially preventing upstream ride participants from interrupting water flow to downstream ride participants.

7. The water ride apparatus of claim 1 wherein said ride surface is inclined in a direction transverse to said shallow flow of water so as to facilitate clearing of transient surges of water occurring therein.

8. The water ride apparatus of claim 7 wherein said ride surface is inclined at an angle of at least about five degrees.

9. A multi-participant water ride apparatus for supporting a shallow flow of water thereon upon which ride participants may perform water skimming maneuvers, said water ride apparatus comprising a ride surface having:

a first flow-supporting surface disposed adjacent an upstream portion of said shallow flow of water defining a substantially sub-equidyne flow area;

a second flow-supporting surface disposed adjacent a downstream portion of said shallow flow of water defining a substantially supra-equidyne flow area; and a third flow-supporting surface contiguous with and curving substantially continuously from said first flow-supporting surface to said second flow-supporting surface defining an intermediate equilibrium flow area;

one or more dividers disposed tangentially to said shallow flow of water defining a plurality of riding lanes for accommodating multiple ride participants and/or ride vehicles;

whereby multiple ride participants can perform water skimming maneuvers on said shallow flow of water while substantially preventing upstream ride participants from interrupting water flow to downstream ride participants.

10. The water ride apparatus of claim 9 wherein the fluid drag forces on a ride participant and/or ride vehicle riding in said sub-equidyne flow area are greater than the gravitational forces exerted on said ride participant and/or ride vehicle in a direction tangential to said shallow flow of water, the fluid drag forces exerted on said ride participant and/or ride vehicle riding in said supra-equidyne flow area are lesser than the gravitational forces exerted on said ride participant and/or ride vehicle in a direction tangential to said shallow flow of water, and the fluid drag forces exerted on said ride participant and/or ride vehicle riding in said equilibrium flow area are substantially balanced by the gravitational forces exerted on said ride participant and/or ride vehicle in a direction tangential to said shallow flow of water such that a ride participant by controlling the angle and direction of said ride participant's body and/or ride vehicle with respect to said shallow flow of water can vary the drag forces exerted on said ride participant and/or ride vehicle in order to perform desirable oscillating water skimming maneuvers whereby said ride participant oscillates between said sub-equidyne, equilibrium and supra-equidyne flow areas.

11. The water ride apparatus of claim 9 further comprising a fourth flow-supporting surface disposed downstream of said second surface defining a second sub-equidyne flow area for allowing safe exiting of ride participants.

12. The water ride apparatus of claim 9 further comprising one or more drains disposed downstream of said second surface adapted to collect said shallow flow of water and direct it to a water recirculation system.

13. A water ride apparatus for supporting a shallow flow of water thereon upon which ride participants may perform oscillating water skimming maneuvers, said water ride apparatus comprising a ride surface having:

a first flow-supporting surface defining a substantially sub-equidyne flow area in which the fluid drag forces on a ride participant and/or ride vehicle are greater than the gravitational forces exerted on said ride participant and/or ride vehicle in a direction tangential to said shallow flow of water;

a second flow-supporting surface defining a substantially supra-equidyne flow area in which the fluid drag forces exerted on said ride participant and/or ride vehicle are lesser than the gravitational forces exerted on said ride participant and/or ride vehicle in a direction tangential to said shallow flow of water; and a third flow-supporting surface between said first flow-supporting surface and said second flow-supporting surface defining an intermediate equilibrium flow area in which the fluid drag forces exerted on said ride participant and/or ride vehicle are substantially balanced by the gravitational forces exerted on said ride participant and/or ride vehicle in a direction tangential to said shallow flow of water;

whereby said ride participant by controlling the angle and direction of said ride participant's body and/or ride vehicle with respect to said shallow flow of water can vary the drag forces exerted on said ride participant and/or ride vehicle in order to perform desirable oscillating water skimming maneuvers whereby said ride participant oscillates between said sub-equidyne, equilibrium and supra-equidyne flow areas.

14. The water ride apparatus of claim 13 wherein said ride surface is formed in the shape of a semi-circular tube having concave cylindrical flow-supporting surfaces of substantially uniform curvature.

15. The water ride apparatus of claim 14 wherein said ride surface is formed in the shape of a complex curve such as an ellipse, parabola, hyperbola and/or spiral.

16. The water ride apparatus of claim 13 wherein said ride surface is formed to simulate the shape of a tunnel wave.

17. The water ride apparatus of claim 14 further comprising a connected ride surface structure comprising a substantially horizontal flat flow-supporting surface defining an extended sub-equidyne flow area for allowing ride participants to increase their speed and/or acceleration by pump turning in said extended sub-equidyne area.

18. The water ride apparatus of claim 13 further comprising one or more dividers disposed tangentially to said shallow flow of water defining a plurality of riding lanes for accommodating multiple ride participants and/or ride vehicles while substantially preventing upstream ride participants from interrupting water flow to downstream ride participants.

19. The water ride apparatus of claim 13 wherein said ride surface is inclined in a direction transverse to said shallow flow of water so as to facilitate clearing of transient surges of water occurring therein.

20. The water ride apparatus of claim 13 further comprising a swale vent for allowing substantially continuous venting of run-off water.

21. A wave forming structure adapted to support a shallow flow of water thereon simulating the shape of a tunnel wave and upon which water skimming maneuvers may be performed, said wave forming structure comprising a ride surface having:

a first flow-supporting surface disposed adjacent an upstream portion of said shallow flow of water defining a substantially sub-equidyne flow area;

a second flow-supporting surface disposed adjacent a downstream portion of said shallow flow of water defining a substantially supra-equidyne flow area; and a third flow-supporting surface contiguous with and curving substantially continuously from said first flow-supporting surface to said second flow-supporting surface defining an intermediate equilibrium flow area;

said first, second and third flow-supporting surfaces being inclined in a direction transverse to said shallow flow of water so as to facilitate clearing of transient surges of water occurring therein.

22. The wave forming structure of claim 21 wherein said flow-supporting surfaces are inclined at an angle of at least about five degrees.

23. The wave forming structure of claim 21 further comprising a swale vent for allowing substantially continuous venting of run-off water.

24. The wave forming structure of claim 21 wherein said first surface is formed in the shape of an opening curve having an increasing radius in the direction of said flow of shallow water.

25. The wave forming structure of claim 21 wherein said first surface is formed in the shape of a closing curve having a decreasing radius in the direction of said flow of shallow water.

26. The wave forming structure of claim 21 further comprising one or more dividers disposed tangentially to said shallow flow of water defining a plurality of riding lanes for accommodating multiple ride participants and/or ride vehicles while substantially preventing upstream ride participants from interrupting water flow to downstream ride participants.

27. The wave forming structure of claim 22 further comprising a connected ride surface structure comprising a substantially horizontal flat flow-supporting surface defining an extended sub-equidyne flow area for allowing ride participants to increase their speed and/or acceleration by pump turning in said extended sub-equidyne area.

28. The wave forming structure of claim 21 further comprising a fourth flow-supporting surface disposed downstream of said second surface defining a second sub-equidyne flow area for allowing safe exiting of ride participants.

29. The water ride apparatus of claim 1 wherein said shallow flow of water is of such depth that the surface boundary layer effects of the water flow over the ride surface are more substantial than wave propagation effects of the water flow on the ride surface.

30. The water ride apparatus of claim 1 wherein said shallow flow of water has a thickness of about 2 cm.

31. The water ride apparatus of claim 1 wherein said shallow flow of water has a thickness between about 2 cm and 8 cm.

32. The water ride apparatus of claim 1 wherein said shallow flow of water has a thickness of about 8 cm or more.

33. The water ride apparatus of claim 9 wherein said shallow flow of water is of such depth that the surface boundary layer effects of the water flow over the ride surface are more substantial than wave propagation effects of the water flow on the ride surface.

34. The water ride apparatus of claim 9 wherein said shallow flow of water has a thickness of about 2 cm.

35. The water ride apparatus of claim 9 wherein said shallow flow of water has a thickness of between about 2 cm and 8 cm.

36. The water ride apparatus of claim 9 wherein said shallow flow of water has a thickness of about 8 cm or more.

37. The water ride apparatus of claim 13 wherein said shallow flow of water is of such depth that the surface boundary layer effects of the water flow over the ride surface are more substantial than wave propagation effects of the water flow on the ride surface.

38. The water ride apparatus of claim 13 wherein said shallow flow of water has a thickness of about 2 cm.

39. The water ride apparatus of claim 13 wherein said shallow flow of water has a thickness of between about 2 cm and 8 cm.

40. The water ride apparatus of claim 13 wherein said shallow flow of water has a thickness of about 8 cm or more.

41. The wave forming structure of claim 21 wherein said shallow flow of water is of such depth that the surface boundary layer effects of the water flow over the ride surface are more substantial than wave propagation effects of the water flow on the ride surface.

42. The wave forming structure of claim 21 wherein said shallow flow of water has a thickness of about 2 cm.

43. The water ride apparatus of claim 21 wherein said shallow flow of water has a thickness of between about 2 cm and 8 cm.

44. The water ride apparatus of claim 21 wherein said shallow flow of water has a thickness of about 8 cm or more.

* * * * *

US005564859C1

(12) EX PARTE REEXAMINATION CERTIFICATE (7890th)

United States Patent

Lochtefeld

(10) Number: US 5,564,859 C1

(45) Certificate Issued: Nov. 30, 2010

(54) METHOD AND APPARATUS FOR IMPROVING SHEET FLOW WATER RIDES

(75) Inventor: Thomas J. Lochtefeld, La Jolla, CA (US)

(73) Assignee: Rick A Briggs, Springfield, IL (US)

Reexamination Request:
No. 90/009,336, Nov. 17, 2008
No. 90/009,584, Sep. 22, 2009

Reexamination Certificate for:

| | |
|---|---|
| Patent No.: | **5,564,859** |
| Issued: | **Oct. 15, 1996** |
| Appl. No.: | **08/393,071** |
| Filed: | **Feb. 23, 1995** |

Related U.S. Application Data

(63) Continuation of application No. 08/074,300, filed on Jun. 9, 1993, now Pat. No. 5,393,170, which is a continuation of application No. 07/577,741, filed on Sep. 4, 1990, now Pat. No. 5,236,280, which is a continuation-in-part of application No. 07/286,964, filed on Dec. 19, 1988, now Pat. No. 4,954,014, which is a continuation-in-part of application No. 07/054,521, filed on May 27, 1987, now Pat. No. 4,792,260.

(51) Int. Cl.

| | |
|---|---|
| ***A63C 19/00*** | (2006.01) |
| ***A63C 19/10*** | (2006.01) |
| ***A63B 69/00*** | (2006.01) |
| ***A63G 31/16*** | (2006.01) |

(52) U.S. Cl. ..... 405/79; 405/52

(58) Field of Classification Search ..... None
See application file for complete search history.

(56) References Cited

U.S. PATENT DOCUMENTS

| | | | |
|---|---|---|---|
| 490,484 | A | 1/1893 | MacKaye |
| 586,718 | A | 7/1897 | Wharton, Jr. |
| 586,983 | A | 7/1897 | Wharton, Jr. |
| 799,708 | A | 9/1905 | Boyce |
| 1,536,875 | A | 5/1925 | Bowen |
| 1,655,498 | A | 1/1928 | Fisch |
| 1,701,842 | A | 2/1929 | Fisch |
| 1,871,215 | A | 8/1932 | Keller et al. |
| 1,884,075 | A | 10/1932 | Meyers |
| 2,815,951 | A | 12/1957 | Baldanza |
| 3,005,207 | A | 10/1961 | Matral |
| 3,038,760 | A | 6/1962 | Crooke |
| 3,085,404 | A | 4/1963 | Smith |
| 3,216,455 | A | 11/1965 | Cornell et al. |
| 3,473,334 | A | 10/1969 | Dexter |
| 3,477,233 | A | 11/1969 | Anderson |
| 3,478,444 | A | 11/1969 | Presnell |
| 3,557,559 | A | 1/1971 | Barr |
| 3,562,823 | A | 2/1971 | Koster |
| 3,565,491 | A | 2/1971 | Frazoer |
| 3,598,402 | A | 8/1971 | Frenzl |
| 3,789,612 | A | 2/1974 | Richard et al. |
| 3,802,697 | A | 4/1974 | Le Mehaute |
| 3,851,476 | A | 12/1974 | Edwards |
| 3,853,067 | A | 12/1974 | Bacon |
| 3,913,332 | A | 10/1975 | Forsman |
| 3,981,612 | A | 9/1976 | Bunger et al. |
| 4,062,192 | A | 12/1977 | Biewer |
| 4,197,815 | A | 4/1980 | Brazelton |
| 4,201,496 | A | 5/1980 | Anderson |
| 4,276,664 | A | 7/1981 | Baker |
| 4,339,122 | A | 7/1982 | Croul |
| 4,522,535 | A | 6/1985 | Bastenhof |
| 4,539,719 | A | 9/1985 | Schuster et al. |
| 4,564,190 | A | 1/1986 | Frenzl |
| 4,662,781 | A | 5/1987 | Tinkler |
| 4,790,685 | A | 12/1988 | Scott et al. |
| 4,792,260 | A | 12/1988 | Sauerbier |
| 4,836,521 | A | 6/1989 | Barber |
| 4,905,987 | A | 3/1990 | Frenzi |
| 4,954,014 | A | 9/1990 | Sauerbier |
| 5,171,101 | A | 12/1992 | Sauerbier et al. |
| 5,236,280 | A | 8/1993 | Lochtefeld |
| RE34,407 | E | 10/1993 | Frenzl |
| 5,267,812 | A | 12/1993 | Suzuki et al. |
| 5,271,692 | A | 12/1993 | Lochtefeld |
| 5,285,536 | A | 2/1994 | Long |
| 5,342,145 | A | 8/1994 | Cohen |
| 5,387,159 | A | 2/1995 | Hilgert et al. |
| 5,393,170 | A | 2/1995 | Lochtefeld |
| 5,401,117 | A | 3/1995 | Lochtefeld |
| 5,564,859 | A | 10/1996 | Lochtefeld |
| 5,621,925 | A | 4/1997 | Bastenhof |
| 5,628,584 | A | 5/1997 | Lochtefeld |
| 5,738,590 | A | 4/1998 | Lochtefeld |
| 5,899,633 | A | 5/1999 | Lochtefeld |
| 5,899,634 | A | 5/1999 | Lochtefeld |
| 6,019,547 | A | 2/2000 | Hill |
| 6,132,317 | A | 10/2000 | Lochtefeld |
| 6,319,137 | B1 | 11/2001 | Lochtefeld |
| 6,336,771 | B1 | 1/2002 | Hill |
| 6,716,107 | B2 | 4/2004 | Lochtefeld |

FOREIGN PATENT DOCUMENTS

| | | |
|---|---|---|
| CH | 0176562 | 4/1935 |
| DE | 0159793 | 4/1905 |
| DE | 0271412 | 3/1914 |

(Continued)

OTHER PUBLICATIONS

HG Hornung and P Killen; "A Stationary Oblique Breaking Wave for Laboratory Testing of Surfboards"; Department of Physics, Aust. Nat. UNiversity; May 7, 1976.

(Continued)

*Primary Examiner*—Catherine S. Williams

(57) ABSTRACT

An amusement apparatus for water sports activities wherein a flowing body of water is provided. The water moves across an inclined, declined or horizontal riding surface upon which the velocity, volume and gravitational dynamics of the flowing body of water is such that a rider may perform water skimming/simulated surfing maneuvers thereon. Composite structures with horizontal and inclined surfaces and varying flow velocity over time across specifically shaped structures permit water skimming/simulated surfing maneuvers on unbroken, spilling or tunnel type wave forms. Asymmetry in the downstream ridge line of an inclined surface allows spilling type wave formations as well as facilitating the removal of a transient surge. A novel fluid "half-pipe" waveform is also introduced.

FOREIGN PATENT DOCUMENTS

| | | |
|---|---|---|
| DE | 0373684 | 4/1923 |
| DE | 2222594 | 11/1973 |
| DE | 2714223 | 5/1978 |
| DE | 3445976 | 12/1984 |
| EP | 0096216 | 2/1983 |
| EP | 0298853 | 1/1989 |
| EP | 0547117 | 10/1995 |
| EP | 0629139 | 5/1997 |
| FR | 0761489 | 9/1933 |
| FR | 1019527 | 1/1953 |
| FR | 1300144 | 12/1962 |
| FR | 1539959 | 9/1968 |
| GB | 375684 | 6/1932 |
| GB | 1090262 | 11/1967 |
| GB | 1118083 | 6/1968 |
| GB | 1159269 | 7/1969 |
| JP | 52-41392 | 3/1977 |
| SU | 0212138 | 4/1968 |
| SU | 682238 | 8/1979 |
| SU | 0953075 | 8/1982 |
| WO | WO 83/04375 A1 | 12/1983 |
| WO | WO 90/06790 | 6/1990 |
| WO | WO 92/04087 | 3/1992 |
| WO | WO 93/17762 | 9/1993 |

OTHER PUBLICATIONS

Bakhmeteff, B. *Hydraulics of Open Channels,* McGraw–Hill, 1932, pp. 292–294.

Frenzl, Dr. O., "Surfing–Pool als Skipistensimulator," Apr. 1977.

Hornung/Killen, "A Stationary Oblique Breaking Wave for Laboratory Testing of Surfboards," May 7, 1976.

Hornung, PhD, Hans, "Surfing im Labor, die Stromungsmechanik des Wellenreitens," vol. 32, Feb. 1981, pp. 21–26.

Killen, "Model Studies for a Wave Riding Facility," Fluid Mechanics Conference, Brisbane, Aug. 18–22, 1980.

Killen/Stalker, "A Facility for Wave Riding Research," 8$^{th}$ Australasian Fluid Mechanics Conference, Univ. of Newcastle, N.S.W., Dec. 2, 1983, pp. 2B.1–2B.4.

N. Rajaratnam, "Hydraulic Jumps," in: Advances in Hydroscience, V.T. Chow, ed., vol. 1–4, Academic Press, New York, NY, pp. 197–199, 246–249, 254, 255, 270–280.

Surfer Magazine, "Conquering the Bay," vol. 28, No. 5, May 1987, p. 41.

Surfer Magazine, "Going Nowhere Fast," vol. 25, No. 7, Jul. 1984, p. 129.

Surfer Magazine, "Aussie Invents New Type Wave Machine," vol. 25, No. 5, May 1984, p. 25.

Report on the Filing or Determination of an Action regarding A Patent or Trademark. Case No. 08–CV–0928 W WMc; *Wave Loch, Inc.* v. *American Wave Machines, Inc.*

Complaint For Patent Infringement. Case No. 08–CV–0928 W WMc; *Wave Loch, Inc.* v. *American Wave Machines, Inc.*

Defendant American Wave Machines, Inc.'s Answer and Counter Claims to Plaintiffs Wave Loch, Inc. and Light Wave, LP. Case No. 08–CV–0928 W WMc; *Wave Loch, Inc.* v. *American Wave Machines, Inc.*

Plaintiffs' Reply to Defendant's Counterclaims. Case No. 08–CV–0928 W WMc. *Wave Loch, Inc.* v. *American Wave Machines, Inc.*

Plaintiffs' Initial Disclosures Pursuant to Rule 26(a). Case No. 08–CV–0928 W WMc. *Wave Loch, Inc.* v. *American Wave Machines, Inc.*

Defendant/Counter–Claimant American Wave Machine's Initial Disclosures Pursuant to Federal Rule 26(a). Case No. 08–CV–0928 W WMc. *Wave Loch, Inc.* v. *American Wave Machines, Inc.*

Defendant American Wave Machines, Inc.'s Responses to Plaintiffs' Interrogatories (Nos. 1–15). Case No. 08–CV–0928 W WMc. *Wave Loch, Inc.* v. *American Wave Machines, Inc.*

Defendant American Wave Machines, Inc.'s Supplemental Responses to Plaintiffs' Interrogatories. Case No. 08–CV–0928 W WMc. *Wave Loch, Inc.* v. *American Wave Machines, Inc.*

Letter Dated Jan. 10, 2006 from Bruce McFarland of American Wave Machines, Inc. to "To Whom it May Concern." Re: "Evaluation of Lochtefeld and other patents as compared to the offerings of American Wave Machines, Inc."; Document Produced in Case No. 08–CV–0928 W WMc. *Wave Loch, Inc.* v. *American Wave Machines, Inc.*

Plaintiffs' Disclosure of Asserted Claims and Preliminary Infringement Contentions. Case No. 08–CV–0928 W WMc. *Wave Loch, Inc.* v. *American Wave Machines, Inc.*

Defendant American Wave Machines, Inc.'s Preliminary Invalidity Contentions. Case No. 08–CV–0928 W WMc. *Wave Loch, Inc.* v. *American Wave Machines, Inc.*

Plaintiffs' Preliminary Claim Constructions and Preliminary Identification of Extrinsic Evidence. Case No. 08–CV–0928 W WMc. *Wave Loch, Inc.* v. *American Wave Machines, Inc.*

Defendant American Wave Machines, Inc.'s Preliminary Claim Construction and Identification of Extrinsic Evidence. Case No. 08–CV–0928 MMA WMc. *Wave Loch, Inc.* v. *American Wave Machines, Inc.*

Plaintiffs' Responsive Claim Constructions and Identification of Extrinsic Evidence. Case No. 08–CV–0928 MMA WMc. *Wave Loch, Inc.* v. *American Wave Machines, Inc.*

Defendant American Wave Machines, Inc.'s Responsive Claim Construction and Identification of Extrinsic Evidence. Case No. 08–CV–0928 W WMc. *Wave Loch, Inc.* v. *American Wave Machines, Inc.*

Joint Claim Construction Chart. Case No. 08–CV–0928 MMA WMc. *Wave Loch, Inc.* v. *American Wave Machines, Inc.*

Order Granting Defendant's Motion to Stay Proceeding. Case No. 08–CV–0928 MMA WMc. *Wave Loch, Inc.* v. *American Wave Machines, Inc.*

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 13 is determined to be patentable as amended.

Claims 37 and 40, dependent on an amended claim, are determined to be patentable.

New claims 45-57 are added and determined to be patentable.

Claims 1-12, 14-36, 38-39 and 41-44 were not reexamined.

13. A water ride apparatus for supporting a shallow flow of water thereon upon which ride participants may perform oscillating water skimming maneuvers, said water ride apparatus comprising a ride surface having:

a first flow-supporting surface defining a substantially sub-equidyne flow area in which the fluid drag forces on a ride participant and/or ride vehicle are greater than the gravitational forces exerted on said ride participant and/or ride vehicle in a direction tangential to said shallow flow of water;

a second flow-supporting surface defining a substantially supra-equidyne flow area in which the fluid drag forces exerted on said ride participant and/or ride vehicle are lesser than the gravitational forces exerted on said ride participant and/or ride vehicle in a direction tangential to said shallow flow of water; and a third flow-supporting surface between said first flow-supporting surface and said second flow-supporting surface defining an intermediate equilibrium flow area in which the fluid drag forces exerted on said ride participant and/or ride vehicle are substantially balanced by the gravitational forces exerted on said ride participant and/or ride vehicle in a direction tangential to said shallow flow of water;

*wherein the first, third and second flow-supporting surfaces are contiguous;* whereby said ride participant by controlling the angle and direction of said ride participant's body and/or ride vehicle with respect to said shallow flow of water can vary the drag forces exerted on said ride participant and/or ride vehicle in order to perform desirable oscillating water skimming maneuvers whereby said ride participant oscillates between said sub-equidyne, equilibrium and supra-equidyne flow areas*;*

*wherein each of the first, second, and third flow-supporting surfaces has a longitudinal length in the direction of the flow of water, and the length of the first flow-supporting surface is greater than each of the lengths of the second and third flow-supporting surfaces; and*

*wherein the first flow-supporting surface comprises a transition point, the first flow-supporting surface being planar upstream of the transition point and concave upwardly immediately downstream of the transition point, and a longitudinal length of the planar first flow-supporting surface upstream of the transition point is greater than a longitudinal length from the transition point to the vertically highest point of the second flow-supporting surface.*

*45. The water ride apparatus of claim 13, wherein the length of the first flow-supporting surface is sufficient so that a ride participant having momentum obtained from sliding from the supra-equidyne area to the sub-equidyne area can extend his body and simultaneously carve a turn to return to the supra-equidyne area.*

*46. The water ride apparatus of claim 13, wherein the sub-equidyne area is substantially horizontal.*

*47. The water ride apparatus of claim 13, wherein the planar first flow-supporting surface upstream of the transition point is horizontal.*

*48. A water ride apparatus for supporting a shallow flow of water thereon upon which ride participants may perform oscillating water skimming maneuvers, said water ride apparatus comprising a ride surface having:*

*a first flow-supporting surface defining a substantially sub-equidyne flow area in which the fluid drag forces on a ride participant and/or ride vehicle are greater than the gravitational forces exerted on said ride participant and/or ride vehicle in a direction tangential to said shallow flow of water;*

*a second flow-supporting surface defining a substantially supra-equidyne flow area in which the fluid drag forces exerted on said ride participant and/or ride vehicle are lesser than the gravitational forces exerted on said ride participant and/or ride vehicle in a direction tangential to said shallow flow of water; and*

*a third flow-supporting surface between said first flow-supporting surface and said second flow-supporting surface defining an intermediate equilibrium flow area in which the fluid drag forces exerted on said ride participant and/or ride vehicle are substantially balanced by the gravitational forces exerted on said ride participant and/or ride vehicle in a direction tangential to said shallow flow of water;*

*wherein the first, third and second flow-supporting surfaces are contiguous;*

*whereby said ride participant by controlling the angle and direction of said ride participant's body and/or ride vehicle with respect to said shallow flow of water can vary the drag forces exerted on said ride participant and/or ride vehicle in order to perform desirable oscillating water skimming maneuvers whereby said ride participant oscillates between said sub-equidyne, equilibrium and supra-equidyne flow areas; and*

*wherein each of the first, second, and third flow-supporting surfaces has a longitudinal length in the direction of the flow of water, and the length of the first flow-supporting surface is greater than each of the lengths of the second and third flow-supporting surfaces;*

*wherein the first flow-supporting surface comprises a transition point, the first flow-supporting surface being horizontal upstream of the transition point and upwardly inclined immediately downstream of the transition point, and a longitudinal length of the horizontal first flow-supporting surface upstream of the transition*

*point is greater than a longitudinal length from the transition point to the vertically highest point of the second flow-supporting surface.*

*49. The water ride apparatus of claim 48, wherein the longitudinal length of the first flow-supporting surface upstream of the transition point is at least 1.5 to 4 times the total vertical height of the ride surface from the transition point to the vertically highest point of the ride surface.*

*50. A water ride apparatus for supporting a shallow flow of water thereon upon which ride participants may perform oscillating water skimming maneuvers, said water ride apparatus comprising a ride surface having:*

*a first flow-supporting surface defining a substantially sub-equidyne flow area in which the fluid drag forces on a ride participant and/or ride vehicle are greater than the gravitational forces exerted on said ride participant and/or ride vehicle in a direction tangential to said shallow flow of water;*

*a second flow-supporting surface defining a substantially supra-equidyne flow area in which the fluid drag forces exerted on said ride participant and/or ride vehicle are lesser than the gravitational forces exerted on said ride participant and/or ride vehicle in a direction tangential to said shallow flow of water; and*

*a third flow-supporting surface between said first flow-supporting surface and said second flow-supporting surface defining an intermediate equilibrium flow area in which the fluid drag forces exerted on said ride participant and/or ride vehicle are substantially balanced by the gravitational forces exerted on said ride participant and/or ride vehicle in a direction tangential to said shallow flow of water;*

*wherein the first, third and second flow-supporting surfaces are contiguous;*

*whereby said ride participant by controlling the angle and direction of said ride participant's body and/or ride vehicle with respect to said shallow flow of water can vary the drag forces exerted on said ride participant and/or ride vehicle in order to perform desirable oscillating water skimming maneuvers whereby said ride participant oscillates between said sub-equidyne, equilibrium and supra-equidyne flow areas;*

*wherein each of the first, second, and third flow-supporting surfaces has a longitudinal length in the direction of the flow of water, and the length of the first flow-supporting surface is greater than each of the lengths of the second and third flow-supporting surfaces; and*

*wherein the first flow-supporting surface comprises a transition point at which the first flow-supporting surface has a slope of zero, the first flow-supporting surface being elongate upstream of the transition point, the ride surface being upwardly inclined immdediately downstream of the transition point, and a longitudinal length of the first flow-supporting surface upstream of the transition point is greater than a longitudinal length of the ride surface from the transition point to the vertically highest point of the second flow-supporting surface.*

*51. The water ride apparatus of claim 50, wherein the longitudinal length of the first flow-supporting surface upstream of the transition point is at least 1.5 to 4 times the total vertical height of the ride surface from the transition point to the vertically highest point of the ride surface.*

*52. A water ride apparatus for supporting a shallow flow of water thereon upon which ride participants may perform oscillating water skimming maneuvers, said water ride apparatus comprising a ride surface having:*

*a first flow-supporting surface defining a substantially sub-equidyne flow area in which the fluid drag forces on a ride participant and/or ride vehicle are greater than the gravitational forces exerted on said ride participant and/or ride vehicle in a direction tangential to said shallow flow of water;*

*a second flow-supporting surface defining a substantially supra-equidyne flow area in which the fluid drag forces exerted on said ride participant and/or ride vehicle are lesser than the gravitational forces exerted on said ride participant and/or ride vehicle in a direction tangential to said shallow flow of water; and*

*a third flow-supporting surface between said first flow-supporting surface and said second flow-supporting surface defining an intermediate equilibrium flow area in which the fluid drag forces exerted on said ride participant and/or ride vehicle are substantially balanced by the gravitational forces exerted on said ride participant and/or ride vehicle in a direction tangential to said shallow flow of water;*

*wherein the first, third and second flow-supporting surfaces are contiguous;*

*whereby said ride participant by controlling the angle and direction of said ride participant's body and/or ride vehicle with respect to said shallow flow of water can vary the drag forces exerted on said ride participant and/or ride vehicle in order to perform desirable oscillating water skimming maneuvers whereby said ride participant oscillates between said sub-equidyne, equilibrium and supra-equidyne flow areas;*

*wherein each of the first, second, and third flow-supporting surfaces has a longitudinal length in the direction of the flow of water, and the length of the first flow-supporting surface is greater than each of the lengths of the second and third flow-supporting surfaces; and*

*wherein the first flow-supporting surface comprises a transition point, the first flow-supporting surface being planar and having a first slope upstream of the transition point and having a second slope immediately downstream of the transition point, the second slope being greater than the first slope, and a longitudinal length of the planar first flow-supporting surface upstream of the transition point is greater than a longitudinal length from the transition point to the vertically highest point of the second flow-supporting surface.*

*53. The water ride apparatus of claim 52, wherein the longitudinal length of the first flow-supporting surface upstream of the transition point is at least 1.5 to 4 times the total vertical height of the ride surface from the transition point to the vertically highest point of the ride surface.*

*54. The water ride apparatus of claim 52, wherein the highest point of the second flow-supporting surface is a downstream ridge, and additionally comprising a downwardly-inclined back surface joining the second flow-supporting surface at the downstream ridge so that the second flow-supporting surface and the back surface form a smooth convex surface, the back surface being in communication with a termination area, and wherein said flow of water can sweep a ride participant over the downstream ridge and down the back surface to the termination area.*

*55. The water ride apparatus of claim 13, wherein the highest point of the second flow-supporting surface is a downstream ridge, and additionally comprising a*

*downwardly-inclined back surface joining the second flow-supporting surface at the downstream ridge so that the second flow-supporting surface and the back surface form a smooth convex surface, the back surface being in communication with a termination area, and wherein said flow of water can sweep a ride participant over the downstream ridge and down the back surface to the termination area.*

*56. The water ride apparatus of claim 48, wherein the highest point of the second flow-supporting surface is a downstream ridge, and additionally comprising a downwardly-inclined back surface joining the second flow-supporting surface at the downstream ridge so that the second flow-supporting surface and the back surface form a smooth convex surface, the back surface being in communication with a termination area, and wherein said flow of water can sweep a ride participant over the downstream ridge and down the back surface to the termination area.*

*57. The water ride apparatus of claim 50, wherein the highest point of the second flow-supporting surface is a downstream ridge, and additionally comprising a downwardly-inclined back surface joining the second flow-supporting surface at the downstream ridge so that the second flow-supporting surface and the back surface form a smooth convex surface, the back surface being in communication with a termination area, and wherein said flow of water can sweep a ride participant over the downstream ridge and down the back surface to the termination area.*

* * * * *

US005564859C2

(12) EX PARTE REEXAMINATION CERTIFICATE (8957th)

United States Patent
Lochtefeld

(10) Number: US 5,564,859 C2
(45) Certificate Issued: Apr. 10, 2012

(54) METHOD AND APPARATUS FOR IMPROVING SHEET FLOW WATER RIDES

(75) Inventor: Thomas J. Lochtefeld, La Jolla, CA (US)

(73) Assignee: Rick A Briggs, Springfield, IL (US)

Reexamination Request:
No. 90/011,526, Mar. 18, 2011

Reexamination Certificate for:

| | |
|---|---|
| Patent No.: | **5,564,859** |
| Issued: | **Oct. 15, 1996** |
| Appl. No.: | **08/393,071** |
| Filed: | **Feb. 23, 1995** |

Reexamination Certificate C1 5,564,859 issued Nov. 30, 2010

Related U.S. Application Data

(63) Continuation of application No. 08/074,300, filed on Jun. 9, 1993, now Pat. No. 5,393,170, which is a continuation of application No. 07/577,741, filed on Sep. 4, 1990, now Pat. No. 5,236,280, which is a continuation-in-part of application No. 07/286,964, filed on Dec. 19, 1988, now Pat. No. 4,954,014, which is a continuation-in-part of application No. 07/054,521, filed on May 27, 1987, now Pat. No. 4,792,260.

(51) Int. Cl.

| | |
|---|---|
| ***E02B 3/00*** | (2006.01) |
| ***E02B 13/00*** | (2006.01) |
| ***A63C 19/10*** | (2006.01) |
| ***A63B 69/00*** | (2006.01) |
| ***A63G 31/16*** | (2006.01) |

(52) U.S. Cl. ..... 405/79; 405/52

(58) Field of Classification Search ..... None
See application file for complete search history.

(56) References Cited

To view the complete listing of prior art documents cited during the proceeding for Reexamination Control Number 90/011,526, please refer to the USPTO's public Patent Application Information Retrieval (PAIR) system under the Display References tab.

*Primary Examiner*—Aaron J. Lewis

(57) ABSTRACT

An amusement apparatus for water sports activities wherein a flowing body of water is provided. The water moves across an inclined, declined or horizontal riding surface upon which the velocity, volume and gravitational dynamics of the flowing body of water is such that a rider may perform water skimming/simulated surfing maneuvers thereon. Composite structures with horizontal and inclined surfaces and varying flow velocity over time across specifically shaped structures permit water skimming/simulated surfing maneuvers on unbroken, spilling or tunnel type wave forms. Asymmetry in the downstream ridge line of an inclined surface allows spilling type wave formations as well as facilitating the removal of a transient surge. A novel fluid "half-pipe" waveform is also introduced.

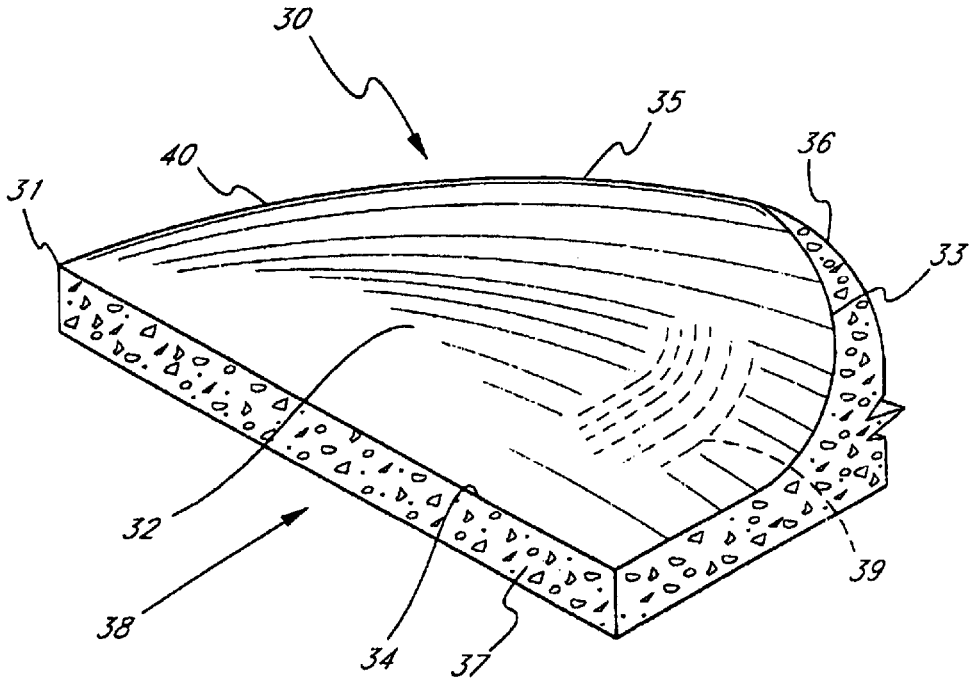

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 13, 37, 40 and 45-57 is confirmed.

Claims 1-12, 14-36, 38, 39 and 41-44 were not reexamined.

* * * * *

US005564859C3

(12) EX PARTE REEXAMINATION CERTIFICATE (10084th)

United States Patent
Lochtefeld

(10) Number: US 5,564,859 C3
(45) Certificate Issued: Mar. 21, 2014

(54) METHOD AND APPARATUS FOR IMPROVING SHEET FLOW WATER RIDES

(75) Inventor: Thomas J. Lochtefeld, La Jolla, CA (US)

(73) Assignee: Knobbe, Martens, Olson & Bear, LLP, Irvine, CA (US)

Reexamination Request:
No. 90/012,649, Sep. 14, 2012

Reexamination Certificate for:

| | |
|---|---|
| Patent No.: | **5,564,859** |
| Issued: | **Oct. 15, 1996** |
| Appl. No.: | **08/393,071** |
| Filed: | **Feb. 23, 1995** |

Reexamination Certificate C1 5,564,859 issued Nov. 30, 2010

Reexamination Certificate C2 5,564,859 issued Apr. 10, 2012

Related U.S. Application Data

(63) Continuation of application No. 08/074,300, filed on Jun. 9, 1993, now Pat. No. 5,393,170, which is a continuation of application No. 07/577,741, filed on Sep. 4, 1990, now Pat. No. 5,236,280, which is a continuation-in-part of application No. 07/286,964, filed on Dec. 19, 1988, now Pat. No. 4,954,014, which is a continuation-in-part of application No. 07/054,521, filed on May 27, 1987, now Pat. No. 4,792,260.

(51) Int. Cl.

| | |
|---|---|
| ***B63B 35/85*** | (2006.01) |
| ***A63G 21/18*** | (2006.01) |
| ***A63C 19/00*** | (2006.01) |

(52) U.S. Cl.
USPC ..... 405/79; 405/52

(58) Field of Classification Search
None
See application file for complete search history.

(56) References Cited

To view the complete listing of prior art documents cited during the proceeding for Reexamination Control Number 90/012,649, please refer to the USPTO's public Patent Application Information Retrieval (PAIR) system under the Display References tab.

*Primary Examiner* — Jeffrey L. Gellner

(57) ABSTRACT

An amusement apparatus for water sports activities wherein a flowing body of water is provided. The water moves across an inclined, declined or horizontal riding surface upon which the velocity, volume and gravitational dynamics of the flowing body of water is such that a rider may perform water skimming/simulated surfing maneuvers thereon. Composite structures with horizontal and inclined surfaces and varying flow velocity over time across specifically shaped structures permit water skimming/simulated surfing maneuvers on unbroken, spilling or tunnel type wave forms. Asymmetry in the downstream ridge line of an inclined surface allows spilling type wave formations as well as facilitating the removal of a transient surge. A novel fluid "half-pipe" waveform is also introduced.

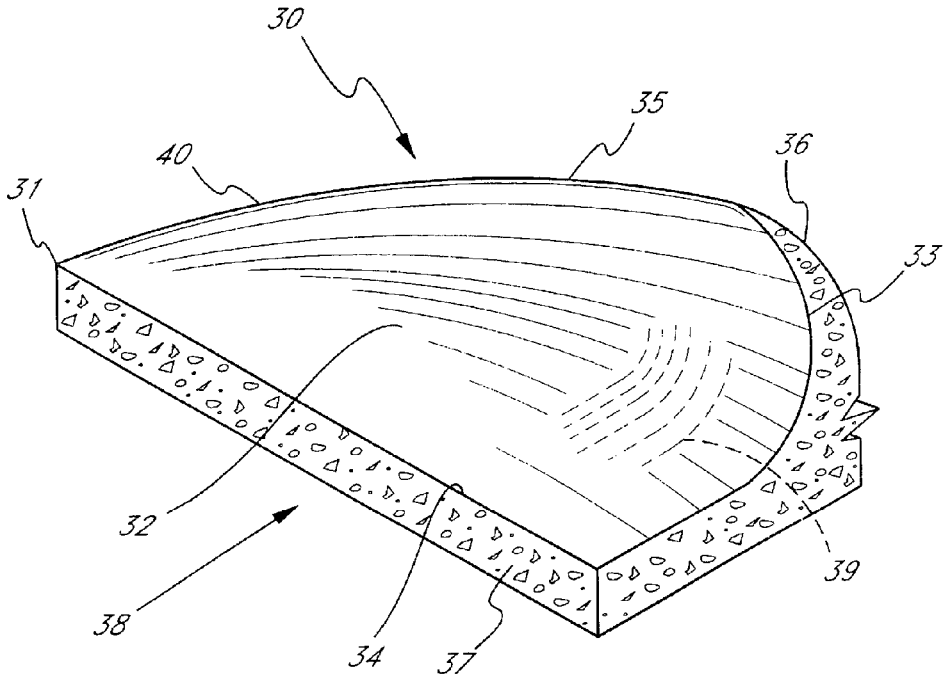

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 13, 37, 40 and 45-57 are cancelled.

Claims 1-12, 14-36, 38, 39 and 41-44 were not reexamined.

* * * * *